US007108962B2

(12) United States Patent
Suzuki et al.

(10) Patent No.: US 7,108,962 B2
(45) **Date of Patent: *Sep. 19, 2006**

(54) PHOTOGRAPHIC PROCESSING COMPOSITION AND IMAGE-FORMING METHOD USING THE SAME

(75) Inventors: Makoto Suzuki, Minami-ashigara (JP); Yasufimi Nakai, Tokyo (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 282 days.

This patent is subject to a terminal disclaimer.

(21) Appl. No.: 10/349,918

(22) Filed: Jan. 24, 2003

(65) Prior Publication Data

US 2003/0198902 A1 Oct. 23, 2003

(30) Foreign Application Priority Data

| | | |
|---|---|---|
| Jan. 25, 2002 | (JP) | 2002-017738 |
| Feb. 14, 2002 | (JP) | 2002-037491 |
| Mar. 6, 2002 | (JP) | 2002-060245 |
| Mar. 29, 2002 | (JP) | 2002-097731 |
| Dec. 4, 2002 | (JP) | 2002-352759 |
| Dec. 6, 2002 | (JP) | 2002-355512 |

(51) Int. Cl.
*G03C 7/413* (2006.01)
*G03C 7/42* (2006.01)

(52) U.S. Cl. ..... 430/461; 430/430; 430/455; 430/460; 430/486; 430/933

(58) Field of Classification Search ..... 430/933, 430/486, 455, 460, 461, 430
See application file for complete search history.

(56) References Cited

U.S. PATENT DOCUMENTS

| | | | | |
|---|---|---|---|---|
| 6,013,425 | A | 1/2000 | Craver et al. | 430/455 |
| 6,153,364 | A | 11/2000 | Goswami et al. | 430/434 |
| 6,288,227 | B1 | 9/2001 | Goswami et al. | 544/197 |
| 6,605,420 | B1 * | 8/2003 | Nakai et al. | 430/486 |
| 6,620,579 | B1 * | 9/2003 | Nakai et al. | 430/486 |
| 6,686,134 | B1 * | 2/2004 | Suzuki et al. | 430/429 |
| 6,753,425 | B1 * | 6/2004 | Nakai et al. | 544/3 |
| 2002/0055071 | A1 | 5/2002 | Nakai et al. | 430/429 |

* cited by examiner

*Primary Examiner*—Hoa Van Le
(74) *Attorney, Agent, or Firm*—Birch, Stewart, Kolasch & Birch, LLP

(57) ABSTRACT

A photographic processing composition, containing at least one compound of formula (I) or (II):

$$A_1\text{-}X\text{-}L\text{-}Y\text{-}A_2 \qquad (I)$$

wherein $A_1$ and $A_2$ each are a specific aryl or aromatic heterocyclic group; L is a specific arylene or divalent aromatic heterocyclic group; X and Y each are a specific divalent group; the compound of (I) contains at least two of —$SO_3M$ or —$CO_2M$, but not contains —N═N— or —SH; M is a hydrogen, alkali or alkali earth metal, ammonium, or pyridinium;

$$\left[A_{11}\text{—}(X_1\text{—}A_{12})_n\right]\left(SO_3M_1)_r\right.\left(CO_2M_1)_s\right. \qquad (II)$$

wherein $A_{11}$ is a specific tri- or tetra-valent aromatic hydrocarbon or aromatic heterocyclic group; $A_{12}$ is an aryl or aromatic heterocyclic group; $X_1$ is a divalent group; $M_1$ is a hydrogen, alkali or alkali earth metal, ammonium, or pyridinium; the molecule of (II) does not contain —N═N— or —SH; n is 3 or 4; r and s each are 0 to 10, (r+s) is 2 or more.

15 Claims, No Drawings

PHOTOGRAPHIC PROCESSING COMPOSITION AND IMAGE-FORMING METHOD USING THE SAME

FIELD OF THE INVENTION

The present invention relates to a photographic processing composition; in particular, a composition that has a superior effect of decreasing stain resulting from residual sensitizing dye in a silver halide color photographic photosensitive material after processing, and that generates no precipitation/deposition when the processing composition is stored at low temperature. Further, the present invention relates to an image-forming method using a silver halide color photographic photosensitive material; in particular, an image-forming method that provides decreased stain resulting from a sensitizing dye remaining in a photosensitive material after processing, and a method for decreasing stain.

BACKGROUND OF THE INVENTION

While digital cameras or color printers advance remarkably, as to the processing of silver halide color photographic photosensitive materials, it is desired to provide prints with high-quality images speedily to customers. However, according to conventional processing, the time for which is merely shortened, the processing ends before sensitizing dyes in a photosensitive material are sufficiently washed out; therefore, a large amount of the sensitizing dyes remaining in white background portions of a color print (i.e. color-remains) causes an original image to be colored. In short, so-called stain is generated. As a result, the value for appreciation of the image is impaired. According to conventional processing, the density of the minimum density portion in a color negative film also increases, so that color balance is damaged. Thus, an appropriate print cannot be provided.

Further, in recent years, the use of tabular silver halide grains, which is an important basic technique in high-sensitivity photosensitive materials for shooting, has produced effects of improving sensitivity and the sensitivity/granularity ratio, since the amount of a sensitizing dye used per unit volume can be made large. However, the amount of the sensitizing dye remaining in the processed photosensitive material has been increased. Depending on conditions for the processing, the increase in the amount of the residual sensitizing dye cannot be ignored. Thus, there is caused a phenomenon in which the density of the minimum density portion of a color negative film increases, or the highlight portion of a color reversal film becomes colored.

Research Disclosure No. 20733 on page 268 (1981) discloses, as an example of a method for removing color-remains resulting from a sensitizing dye, a method of using a bistriazinylaminostylbene disulfonic acid compound. This method has been used widely in the processing of color photographic photosensitive materials. JP-A-6-329936 ("JP-A" means unexamined published Japanese patent application) discloses a bistriazinylaminostylbene disulfonic acid compound with superior solubility that can decrease color-remains even in processing conducted in a shorter time. U.S. Pat. No. 6,013,425 discloses a photographic fixing additive composition and a photographic fixing composition using a bistriazinylaminostylbenedisulfonic acid compound.

It is also desired to make a processing composition thicker, aiming, for example, to decrease the quantity of waste containers, improve recycling ability, and reduce transport and storage costs. JP-A-2001-281823 discloses a bistriazinylaminostylbene disulfonic acid compound that is stably dissolved when a solution of compound has concentrated to have a high salt concentration, and that produces sufficient advantageous effects in shortened-processing when the compound is used at a concentration not more than the solubility thereof.

In general, a bistriazinylaminostylbene disulfonic acid compound is used by being added to a developing solution, to exhibit the effect of decreasing color-remains. However, when the compound is added to a fixing solution, the compound deteriorates in the presence of components of the fixing solution. Therefore, it is difficult to keep the performance of the compound stable. A bistriazinylaminostylbene disulfonic acid compound is originally a fluorescent bleaching agent. Thus, the compound may give unnecessary fluorescent whiteness to the processed photosensitive material.

U.S. Pat. No. 6,153,364 discloses a diaryltriazine compound as an agent for reducing color-remains that has improved stability in a fixing solution, and no fluorescent bleaching ability. Further, U.S. Pat. No. 6,288,227 B1 discloses a compound having improved stability in a concentrated fixing composition and a kit. However, compounds having a higher effect of decreasing color-remains have been desired.

SUMMARY OF THE INVENTION

The present invention is a photographic processing composition, which comprises at least one compound selected from the group consisting of a compound represented by formula (I) and a compound represented by formula (II):

$$A_1\text{-}X\text{-}L\text{-}Y\text{-}A_2 \qquad \text{(I)}$$

wherein, in formula (I), $A_1$ and $A_2$ each independently represent an aryl group or an aromatic heterocyclic group, in which $A_1$ and $A_2$ do not include a triazinyl group; L represents an arylene group or a divalent aromatic heterocyclic group, in which L does not include a triazinylene group; X and Y each independently represent a divalent linking group; the compound represented by formula (I) contains at least two of a group represented by —$SO_3M$ or —$CO_2M$; M represents a hydrogen atom, an alkali metal, an alkali earth metal, an ammonium or a pyridinium; a molecule represented by the formula (I) does not contain a group represented by —N═N— or —SH; and when L is a divalent aromatic heterocyclic group, X and Y each do not represent a divalent linking group singly composed of $N(R_1)$, S or O, in which $R_1$ represents a hydrogen atom, or an alkyl group having 1 to 6 carbon atoms;

$$\left[A_{11}\text{—}(X_1\text{—}A_{12})_n\right]\left[(SO_3M_1)_r\ (CO_2M_1)_s\right] \qquad \text{(II)}$$

wherein, in formula (II), $A_{11}$ represents a tri- or tetra-valent aromatic hydrocarbon group or a tri- or tetra-valent aromatic heterocyclic group, in which $A_{11}$ is not a trivalent group of triazine; $A_{12}$ represents an aryl group or an aromatic heterocyclic group; $X_1$ represents a divalent linking group; $M_1$ represents a hydrogen atom, an alkali metal, an alkali earth metal, an ammonium or a pyridinium; a molecule represented by the formula (II) does not contain a group represented by —N═N— or —SH; n is an integer of 3 or 4; and r and s each are an integer of 0 to 10, in which r+s is 2 or more.

Further, the present invention is an image-forming method, which comprises: using a silver halide color photographic photosensitive material, wherein at least one processing composition used in photographic processing is the above processing composition.

Further, the present invention is a method for decreasing stain resulting from a sensitizing dye remaining in a silver halide color photographic photosensitive material after photographic processing, which comprises: using the above processing composition.

Other and further features and advantages of the invention will appear more fully from the following description.

DETAILED DESCRIPTION OF THE INVENTION

According to the present invention, there is provided the following means:

(1) A photographic processing composition, comprising at least one compound selected from the group consisting of a compound represented by formula (I) and a compound represented by formula (II):

$$A_1\text{-}X\text{-}L\text{-}Y\text{-}A_2 \quad \text{(I)}$$

wherein, in formula (I), $A_1$ and $A_2$ each independently represent an aryl group or an aromatic heterocyclic group, in which $A_1$ and $A_2$ do not include a triazinyl group; L represents an arylene group or a divalent aromatic heterocyclic group, in which L does not include a triazinylene group; X and Y each independently represent a divalent linking group; the compound represented by formula (I) contains at least two of a group represented by $—SO_3M$ or $—CO_2M$; M represents a hydrogen atom, an alkali metal, an alkali earth metal, an ammonium or a pyridinium; a molecule represented by the formula (I) does not contain a group represented by —N═N— or —SH; and when L is a divalent aromatic heterocyclic group, X and Y each do not represent a divalent linking group singly composed of $N(R_1)$, S or O, in which $R_1$ represents a hydrogen atom, or an alkyl group having 1 to 6 carbon atoms;

$$\left[A_{11}\text{—}(X_1\text{—}A_{12})_n\right]\left(\begin{matrix}(SO_3M_1)_r\\(CO_2M_1)_s\end{matrix}\right) \quad \text{(II)}$$

wherein, in formula (II), $A_{11}$ represents a tri- or tetra-valent aromatic hydrocarbon group or a tri- or tetra-valent aromatic heterocyclic group, in which $A_{11}$ is not a trivalent group of triazine; $A_{12}$ represents an aryl group or an aromatic heterocyclic group; $X_1$ represents a divalent linking group; $M_1$ represents a hydrogen atom, an alkali metal, an alkali earth metal, an ammonium or a pyridinium; a molecule represented by the formula (II) does not contain a group represented by —N═N— or —SH; n is an integer of 3 or 4; and r and s each are an integer of 0 to 10, in which r+s is 2 or more.

(2) The photographic processing composition according to the above item (1), wherein, in formula (I), X and Y each independently represent a $—CON(R_1)—$ group, a $—SO_2N(R_1)—$ group or a $—CO_2—$ group; and $R_1$ is a hydrogen atom or an alkyl group having 1 to 6 carbon atoms.

(3) The photographic processing composition according to the above item (1) or (2), wherein, in formula (I), L represents a phenylene group, a naphthylene group or an anthrylene group, each of which may have a substituent.

(4) The photographic processing composition according to the above item (1), wherein, in formula (II), $A_{11}$ represents a tri- or tetra-valent group of benzene, naphthalene or anthracene, each of which may have a substituent.

(5) The photographic processing composition according to any one of the items (1) to (3), wherein, in formula (I), $A_1$ and $A_2$ each independently represent a 5,7-disulfo-2-naphthyl group or a 3,6-disulfo-2-naphthyl group.

(6) The photographic processing composition according to any one of the items (1) to (5), which is used in color-development.

(7) The photographic processing composition according to any one of the items (1) to (5), which is used in bleaching or bleach-fixing.

(8) The photographic processing composition according to any one of the items (1) to (5), which is used in fixing.

(9) The photographic processing composition according to any one of the items (1) to (5), which is used in water washing or stabilizing.

(Hereinafter a first embodiment of the present invention means to include the photographic processing compositions described in the items (1) to (9) above.)

(10) The photographic processing composition according to the above item (1), which is an additive composition for photographic processing, and which at least comprises:

a) at least 0.010 mol/L of at least one compound represented by formula (I):

$$A_1\text{-}X\text{-}L\text{-}Y\text{-}A_2 \quad \text{(I)}$$

wherein, in formula (I), $A_1$ and $A_2$ each independently represent an aryl group or an aromatic heterocyclic group, in which $A_1$ and $A_2$ do not include a triazinyl group; L represents an arylene group or a divalent aromatic heterocyclic group, in which L does not include a triazinylene group; X and Y each independently represent a divalent linking group; the compound represented by formula (I) contains at any position of the groups in a molecule thereof, at least two of a group represented by $—SO_3M$ or $—CO_2M$; M represents a hydrogen atom, an alkali metal, an alkali earth metal, an ammonium or a pyridinium; the molecule represented by formula (I) does not contain a group represented by —N═N— or —SH; and when L is a divalent aromatic heterocyclic group, X and Y each do not represent a divalent linking group singly composed of $N(R_1)$, S or O, in which $R_1$ represents a hydrogen atom, or an alkyl group having 1 to 6 carbon atoms; and b) at least one water-soluble aliphatic compound having 2 to 10 carbon atoms and a molecular mass of less than 200, having in a molecule thereof at least two groups selected from the group consisting of an amino group and a hydroxyl group, and having a molarity of 0.5 mole or more per mole of the compound represented by formula (I).

(11) The additive composition according to the above item (10), which is added to a fixing solution or a fixing replenisher.

(12) The additive composition according to the above item (10), which is added to a bleaching solution or a bleaching replenisher.

(13) The additive composition according to the above item (10), which is added to a pre-bleaching solution or a pre-bleaching replenisher.

(14) The additive composition according to the above item (10), which is added to a developing solution or a developing replenisher.

(15) The additive composition according to the above item (10), which is added to a stabilizing solution or a stabilizing replenisher.

(Hereinafter, a second embodiment of the present invention means to include the additive compositions described in the items (10) to (15) above.)

(16) A method for processing a silver halide color photographic photosensitive material, wherein the additive composition according to any one of the above items (10) to (15) is added to a working solution or a replenisher.

(Hereinafter, a third embodiment of the present invention means to include the processing method described in the item (16) above.)

(17) An image-forming method using a silver halide color photographic photosensitive material, wherein at least one processing composition to be used in photographic processing is the photographic processing composition according to any one of the above items (1) to (15).

(Hereinafter, a fourth embodiment of the present invention means to include the image-forming method described in the item (17) above.)

(18) A method for decreasing stain resulting from a sensitizing dye remaining in a silver halide color photographic photosensitive material after photographic processing, comprising using the photographic processing composition according to any one of the above items (1) to (15).

(Hereinafter, a fifth embodiment of the present invention means to include the method for decreasing stain described in the item (18) above.)

Herein, the present invention means to include all of the above first, second, third, fourth and fifth embodiments, unless otherwise specified.

The formula (I) will be described in detail hereinafter.

$A_1$ and $A_2$ each independently represent an aryl group or an aromatic heterocyclic group. The aryl group is generally a substituted or unsubstituted aryl group having 6 to 20 carbon atoms, preferably 6 to 10 carbon atoms. Examples of the aryl group include a phenyl group, a naphthyl group, a 3-carboxyphenyl group, a 4-carboxyphenyl group, a 3,5-dicarboxyphenyl group, a 4-methoxyphenyl group, a 2-sulfophenyl group, a 4-sulfophenyl group, a 5,7-disulfo-2-naphthyl group, and a 3,6-disulfo-2-naphthyl group. Preferred examples are a 5,7-disulfo-2-naphthyl group and a 3,6-disulfo-2-naphthyl group. The aromatic heterocyclic group is generally a substituted or unsubstituted, 5- or 6-membered aromatic heterocyclic group having 2 to 20 carbon atoms, preferably 2 to 10 carbon atoms and more preferably 2 to 8 carbon atoms. Examples of the aromatic heterocyclic group include a 2-furyl group, a 2-pyrimidinyl group, and a 2-benzothiazolyl group. However, $A_1$ and $A_2$ each are not a triazinyl group.

L represents an arylene group or a divalent aromatic heterocyclic group. The arylene group is generally a substituted or unsubstituted arylene group having 6 to 20 carbon atoms, preferably 6 to 10 carbon atoms. Examples of the arylene group include a phenylene group, a naphthylene group, an anthrylene group, a 3-carboxyphenylene group, a 4-carboxyphenylene group, a 3,5-dicarboxyphenylene group, a 4-methoxyphenylene group, a 2-sulfophenylene group, and a 4-sulfophenylene group. The divalent aromatic heterocyclic group is generally a substituted or unsubstituted divalent aromatic heterocyclic group having 2 to 20 carbon atoms, preferably 2 to 10 carbon atoms, and more preferably 2 to 8 carbon atoms. Examples of the divalent aromatic heterocyclic group include a 3,5-(1,2,4-triazole)-diyl group, a 3,5-isothiazole-diyl group, a 2,6-pyridine-diyl group, a 2,6-pyrazine-diyl group, a 2,6-pyrimidine-diyl group, a 3,6-pyridazine-diyl group and a 1,4-phthalazine-diyl group. However, L is not a triazinylene group. L is preferably an arylene group.

X and Y each independently represent a divalent linking group. Examples of X and Y include a —$CH(R_1)$—group, a —$N(R_1)$— group, a —O— group, a —S— group, a —CON$(R_1)$— group, a —$SO_2N(R_1)$— group and a —$CO_2$— group, in which $R_1$ represents a hydrogen atom or an alkyl group having 1 to 6 carbon atoms. Examples of the alkyl group include a methyl group, an ethyl group, an i-propyl group and a n-propyl group. The divalent linking group is preferably a —$CON(R_1)$— group, a —$SO_2$—$N(R_1)$— group or a —$CO_2$— group, and is more preferably a —$CON(R_1)$— group or a —$CO_2$— group.

The compound of the formula (I) contains at least two groups (preferably two to ten groups, and more preferably two to six groups) selected from the group of a carboxyl group and a sulfo group. These may be in a free form or a salt form. In the case of the salt, the counter ion of the salt is an alkali metal, an alkali earth metal, an ammonium or a pyridinium. An alkali metal or an alkali earth metal ion is preferred. Na or K ion is particularly preferred. Examples of the ammonium ion include an ammonium, a triethylammonium and a tetrabutylammonium group. Among these, ammonium is preferred.

The carboxyl group(s) or the sulfo group(s) is preferably bonded directly to $A_1$ and/or $A_2$, or it is present in a substituent on $A_1$ and/or $A_2$. Alternatively, the carboxyl group or the sulfo group is bonded directly to L, or may be present in a substituent on L.

Furthermore, the molecule of the formula (I) does not contain any group represented by —N═N— or —SH. When L is a divalent aromatic heterocyclic group, X and Y each do not represent a divalent linking group singly composed of $N(R_1)$, S or O.

Next, the formula (II) will be described in detail hereinafter.

$A_{11}$represents a tri- or tetra-valent aromatic hydrocarbon group or a tri- or tetra-valent aromatic heterocyclic group. The tri- or tetra-valent aromatic hydrocarbon group is generally a tri- or tetra-valent aromatic hydrocarbon group having 6 to 20 carbon atoms, preferably 6 to 10 carbon atoms, more preferably 6 to 8 carbon atoms. Examples of the tri- or tetra-valent aromatic hydrocarbon group include a tri- or tetra-valent group derived from a phenyl group, a naphthyl group, a 3-carboxyphenyl group, a 4-carboxyphenyl group, a 4-methoxyphenyl group, a 2-sulfophenyl group, a 4-sulfophenyl group or an anthranyl group. The tri- or tetra-valent aromatic heterocyclic group is generally a substituted or unsubstituted, 5- or 6-membered tri- or tetra-valent aromatic heterocyclic group having 2 to 20 carbon atoms, preferably 2 to 10 carbon atoms, more preferably 2 to 8 carbon atoms. Examples of the tri- or tetra-valent aromatic heterocyclic group include a tri- or tetra-valent group derived from a furyl group, a pyrimidinyl group, or a benzothiazolyl group. However, $A_{11}$ is not a trivalent group of triazine.

$A_{12}$ represents an aryl group or an aromatic heterocyclic group. Specifically, $A_{12}$ has the same meaning as $A_1$ or $A_2$ in the formula (I).

$X_1$ represents a divalent linking group. Specifically, $X_1$ has the same meaning as X or Y in the formula (I).

The —$SO_3M$ group or the —$CO_2M$ group may be present in any position inside the molecule represented by the formula (II). In other words, the —$SO_3M$ group or the —$CO_2M$ group is preferably bonded directly to $A_{11}$ and/or $A_{12}$, or is preferably present in a substituent on $A_{11}$ and/or $A_{12}$. Alternatively, the —$SO_3M$ group or the —$CO_2M$ group may be bonded directly to $X_1$, or be present in a substituent on $X_1$. Another substituent may be present on $A_{11}$ and $A_{12}$.

$M_1$ is a hydrogen atom, an alkali metal, an alkali earth metal, an ammonium group or a pyridininum group. Specifically, $M_1$ has the same meaning as M in the formula (I).

The molecule of the formula (II) does not contain any group represented by —N═N— or —SH.

n is an integer of 3 or 4. r and s each are an integer of 0 to 10, preferably an integer of 1 to 6. r+s is 2 or more, preferably an integer of 2 to 6.

Illustrative examples of the compound represented by the formula (I) or (II) that can be used in the present invention are given below, but the compound for use in the present invention is not limited to the following examples.
I-1)
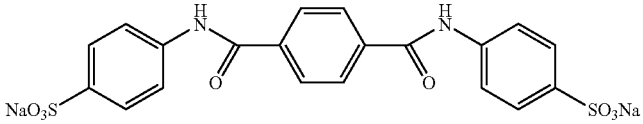
I-2)
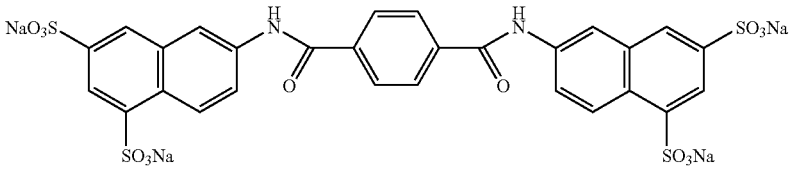
I-3)
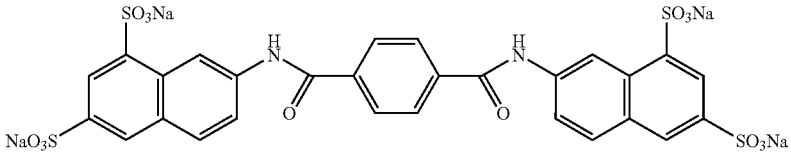
I-4)
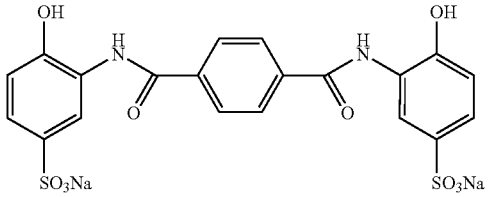
I-5)
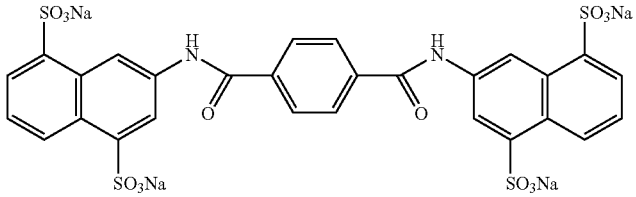
I-6)
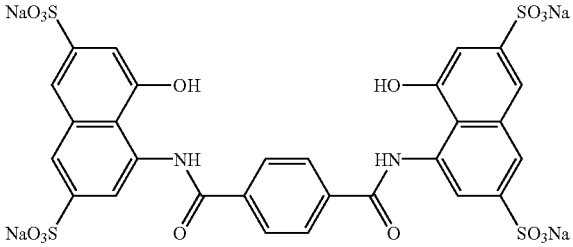
I-7)
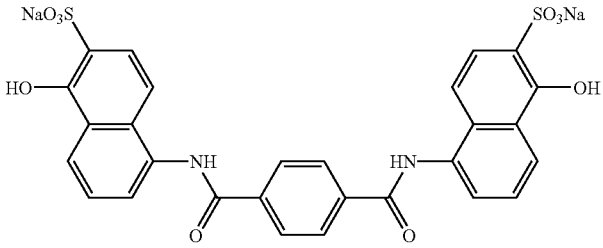

-continued
I-8)
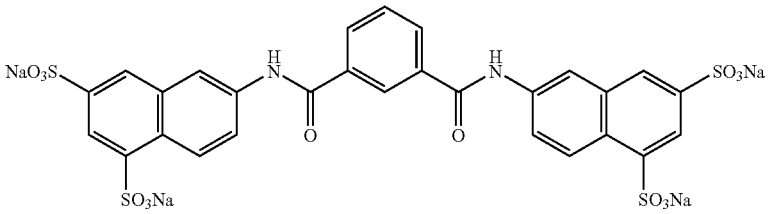
I-9)
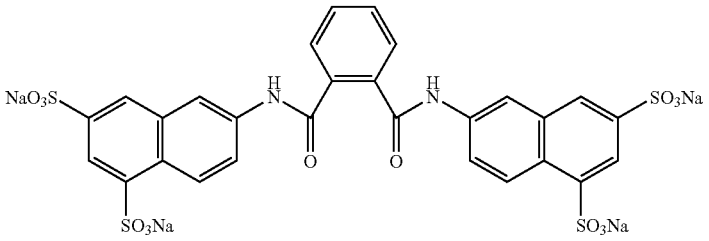
I-10)
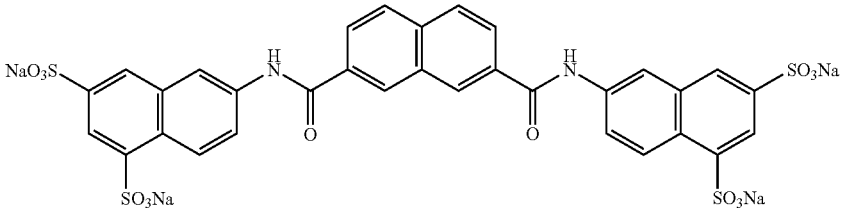
I-11)
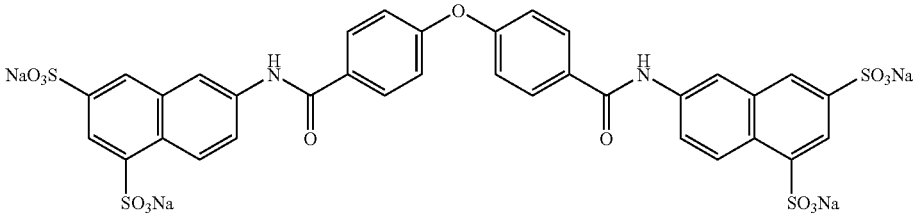
I-12)
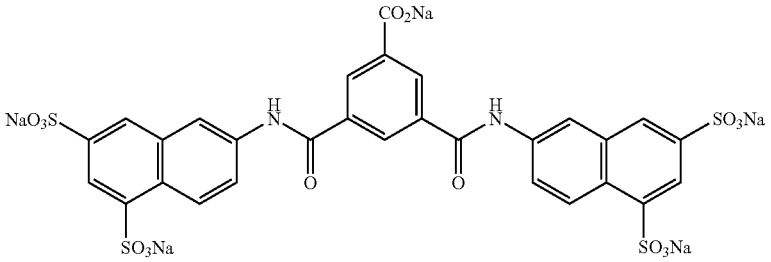
I-13)
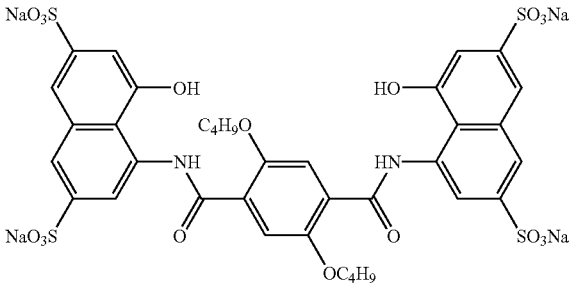

-continued
I-14)
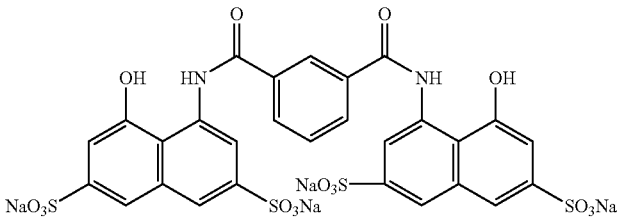
I-15)
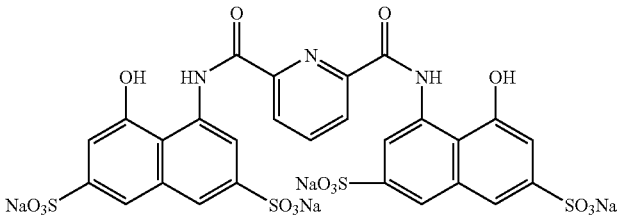
I-16)
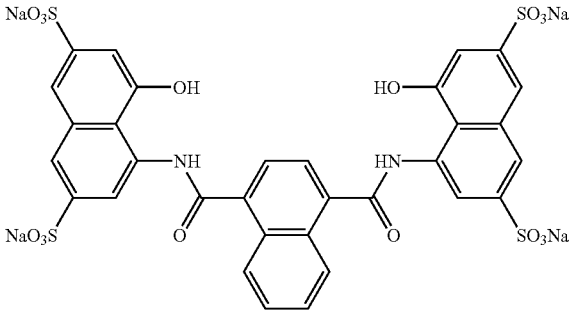
I-17)
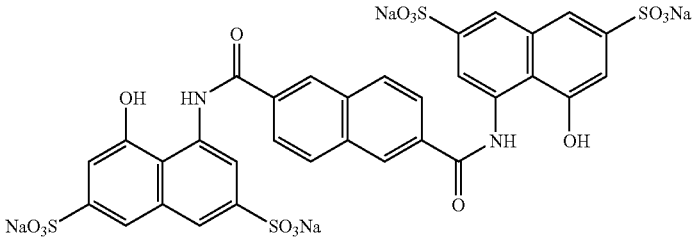
I-18)
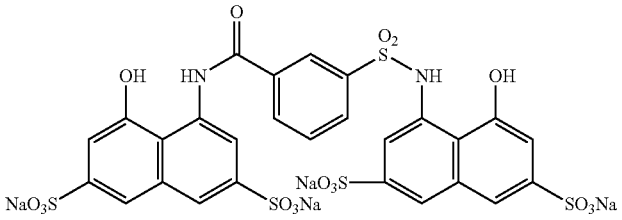
I-19)
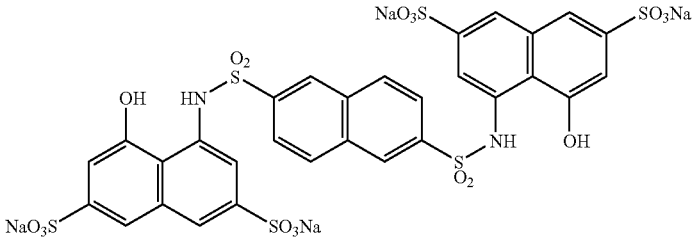

-continued
I-20)
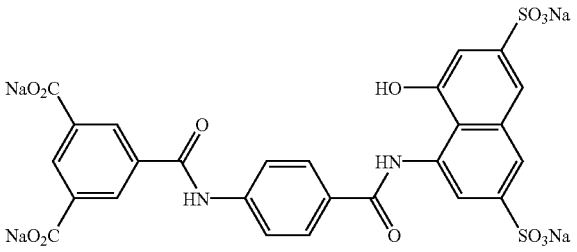
I-21)
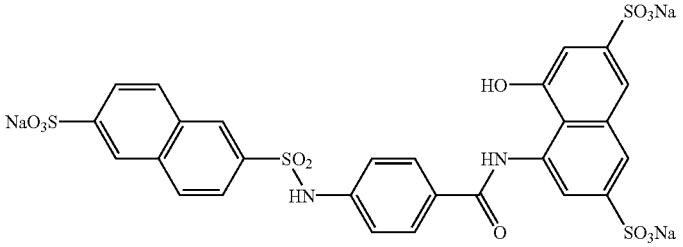
I-22)
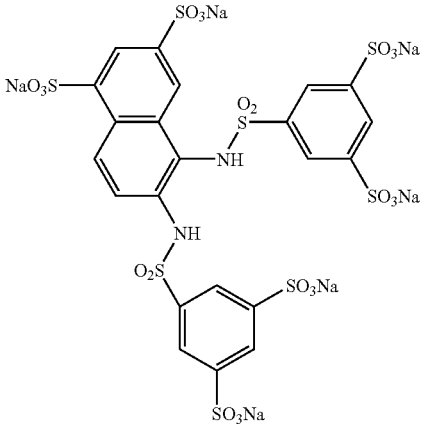
I-23)
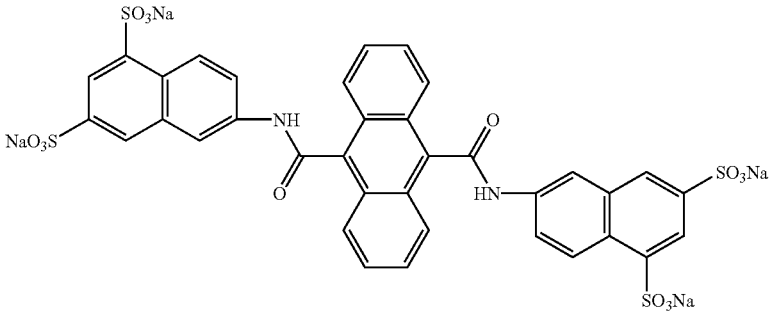
I-24)
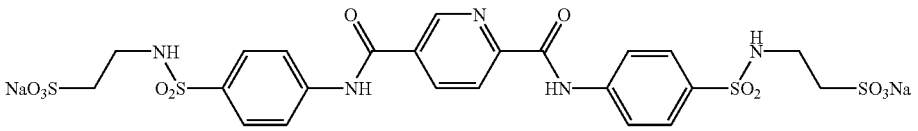
I-25)
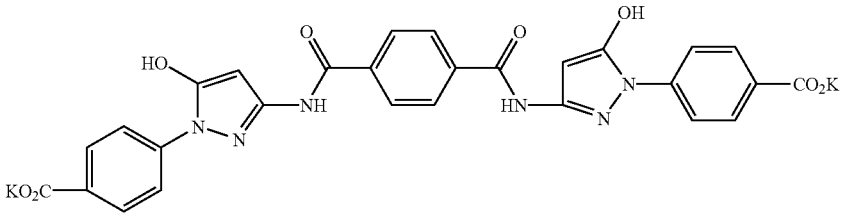

-continued
I-26)
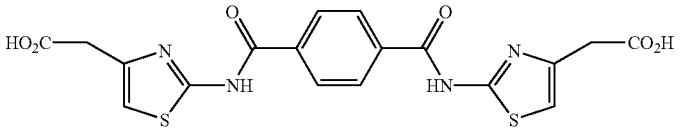
I-27)
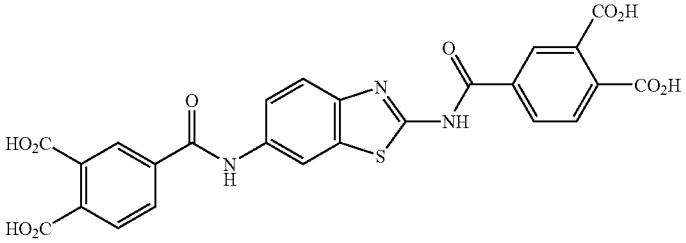
I-28)
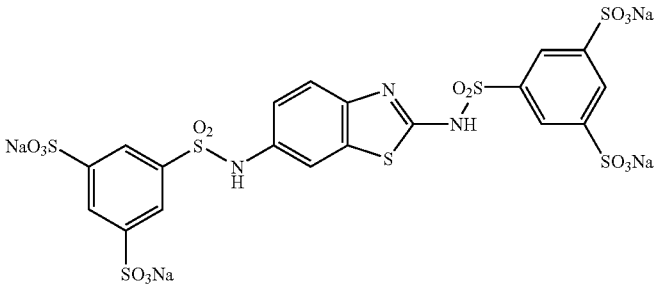
I-29)
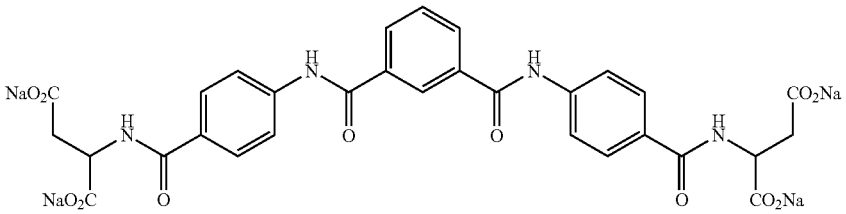
I-30)
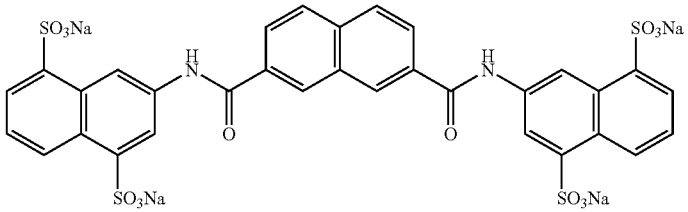
I-31)
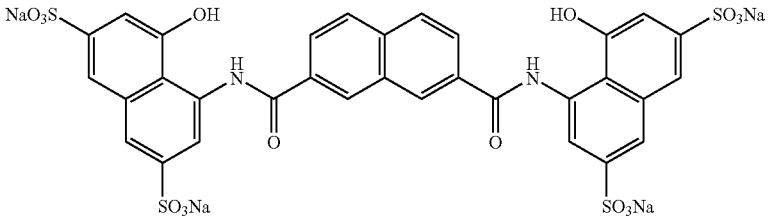
I-32)
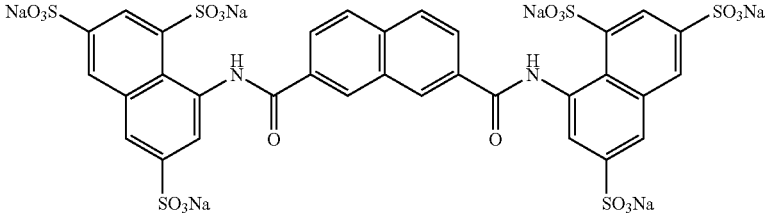

-continued
I-33)
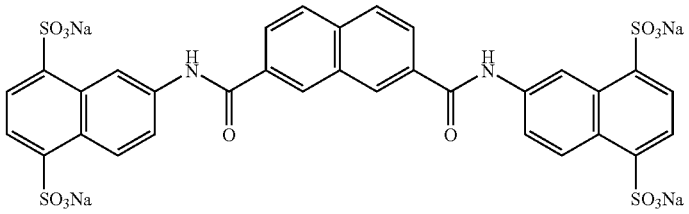
I-34)
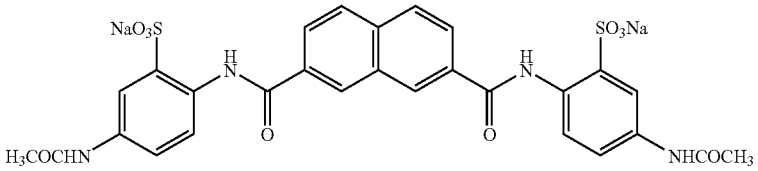
I-35)
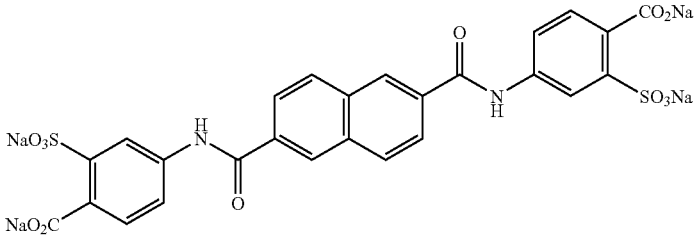
I-36)
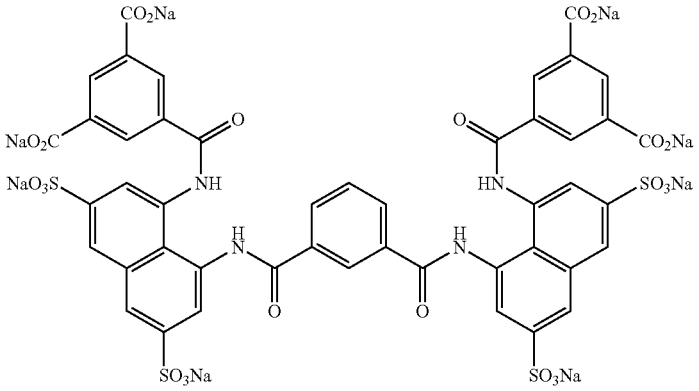
I-37)
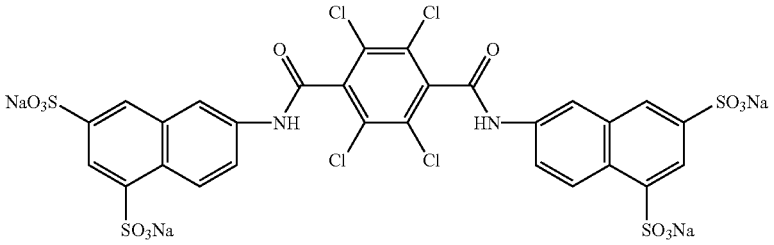
I-38)
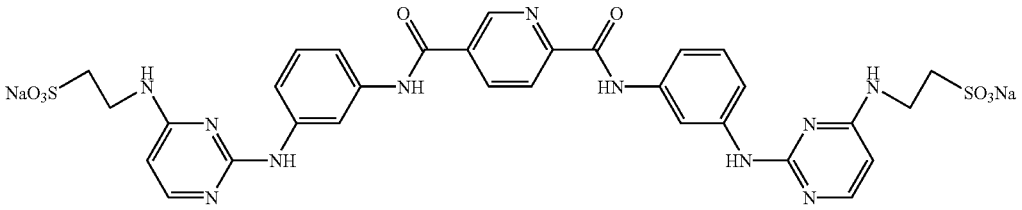

-continued
I-39)
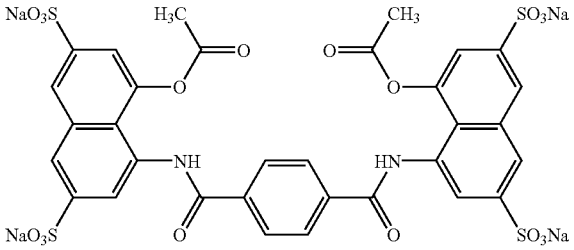
I-40)
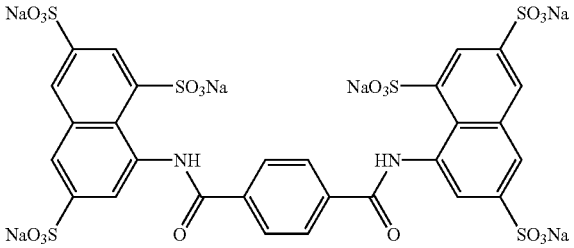
I-41)
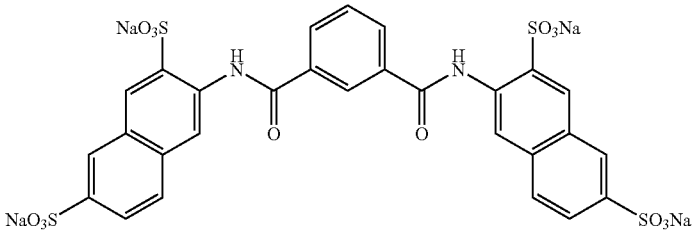
I-42)
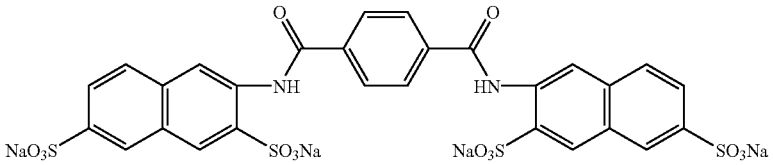
I-43)
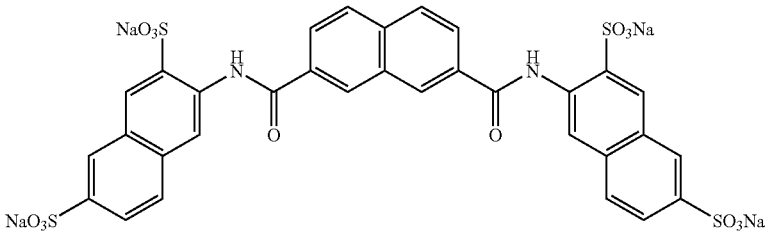
I-44)
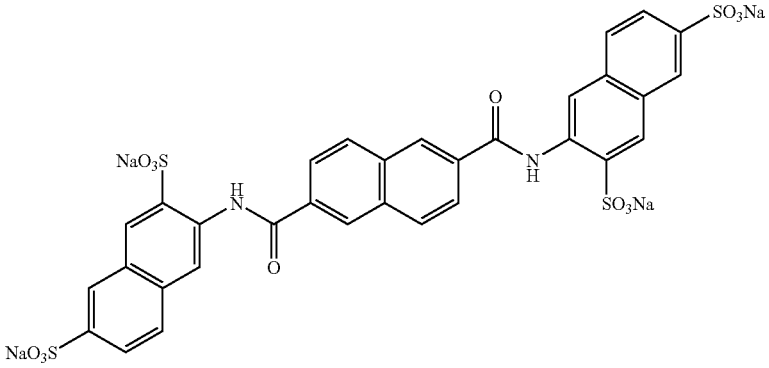

-continued
I-45)
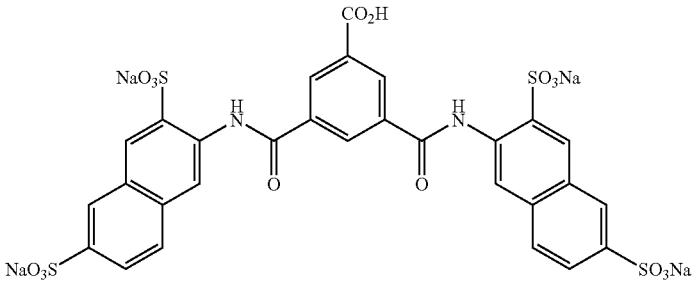
I-46)
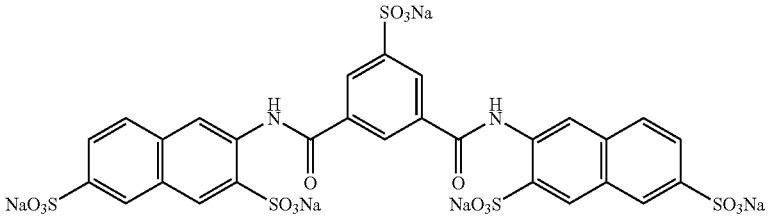
I-47)
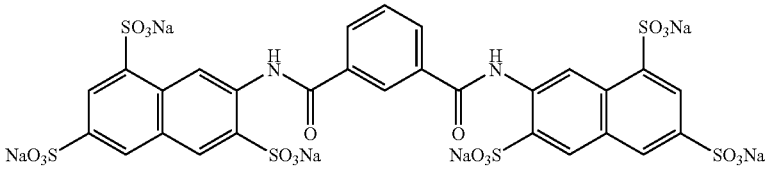
I-48)
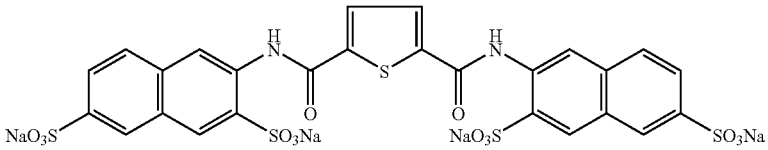
I-49)
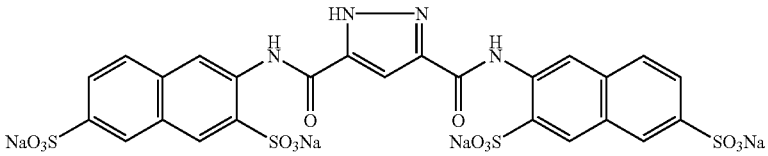
II-1)
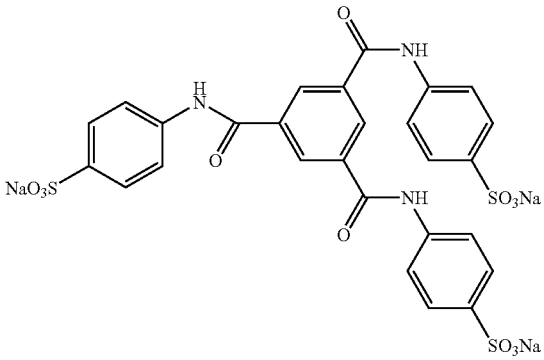

-continued
II-2)
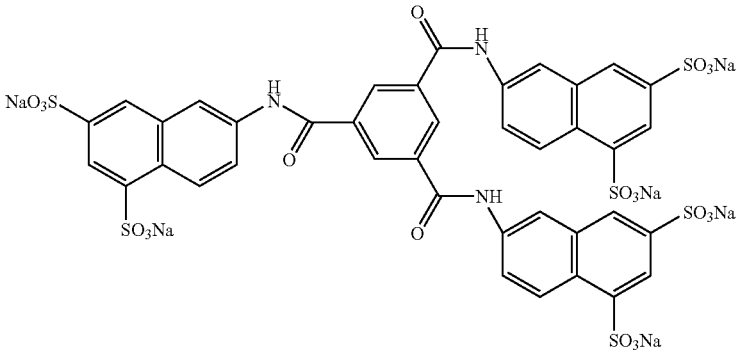
II-3)
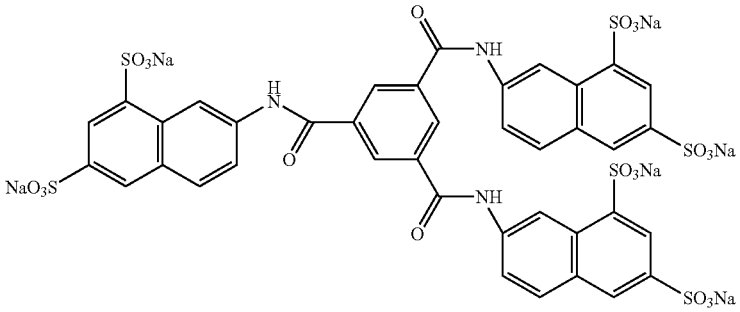
II-4)
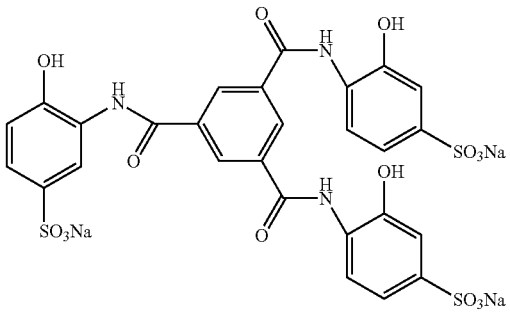
II-5)
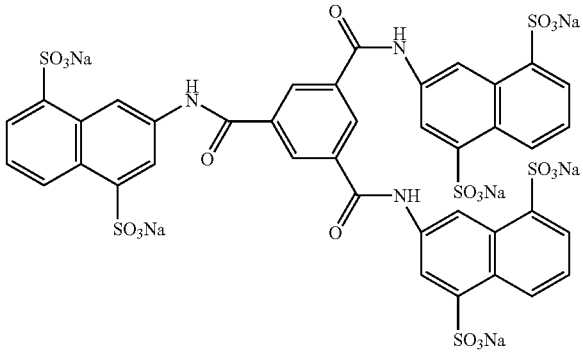

-continued
II-6)
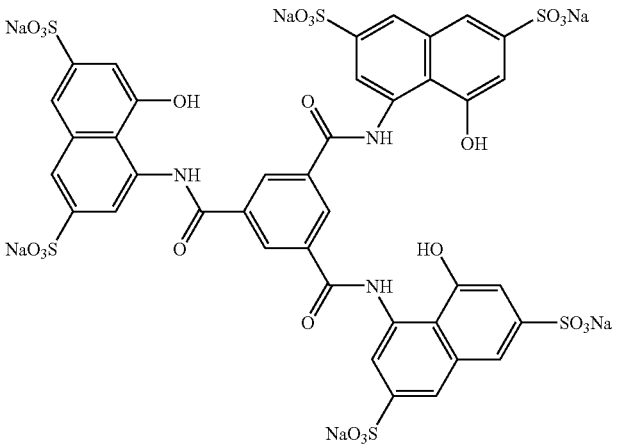
II-7)
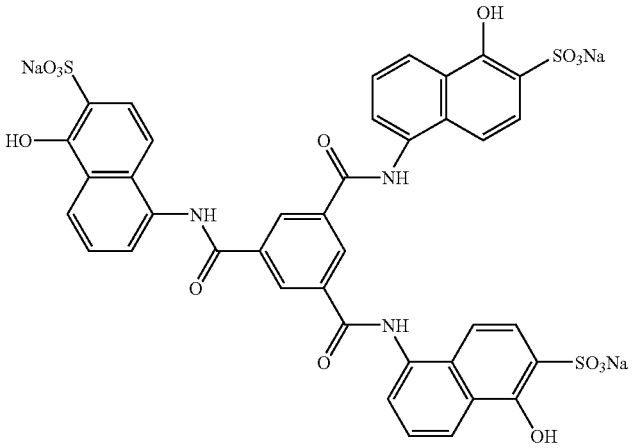
II-8)
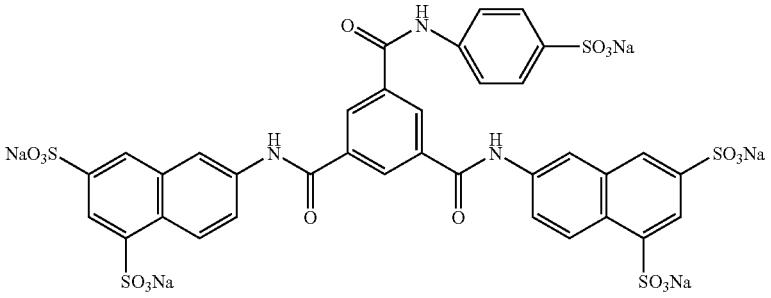
II-9)
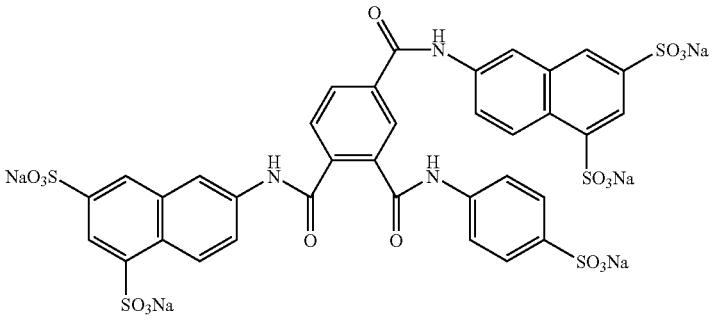

-continued
II-10)
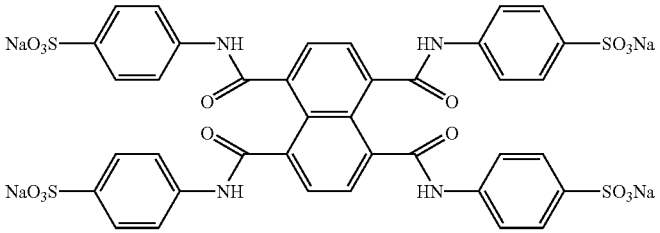
II-11)
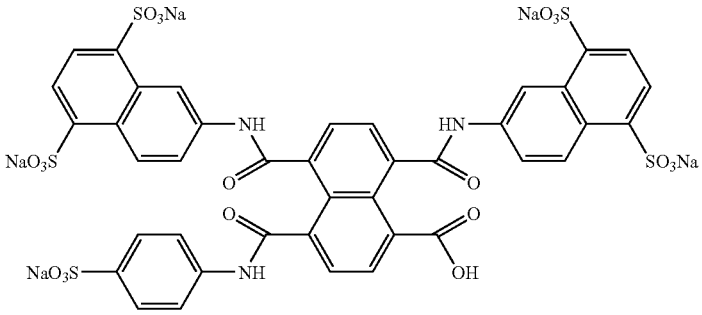
II-12)
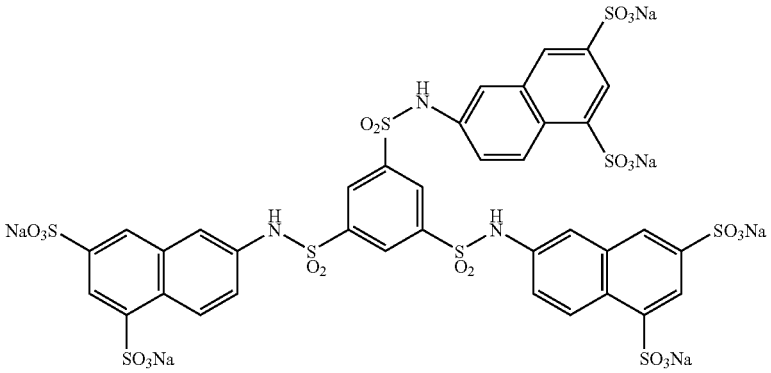
II-13)
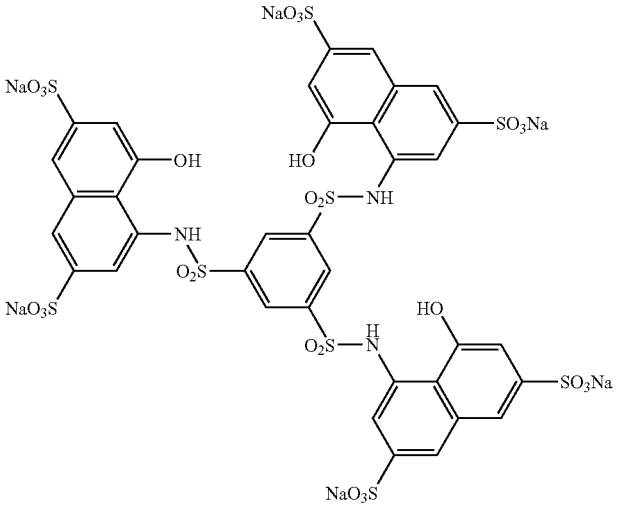

-continued
II-14)
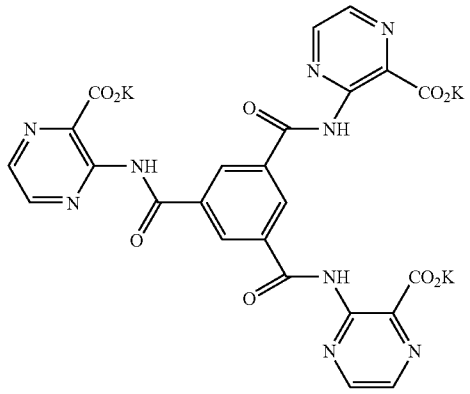
II-15)
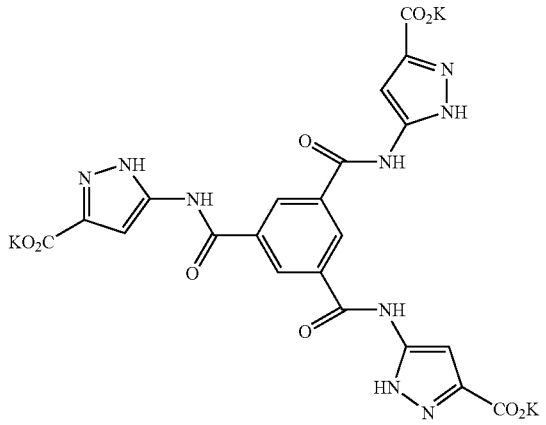
II-16)
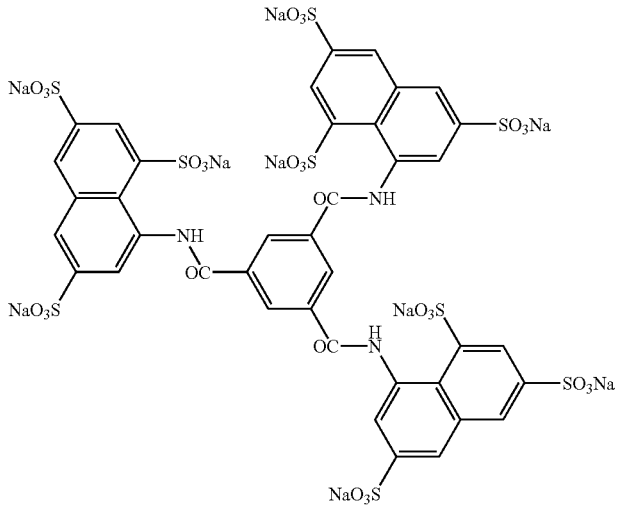

-continued
II-17)
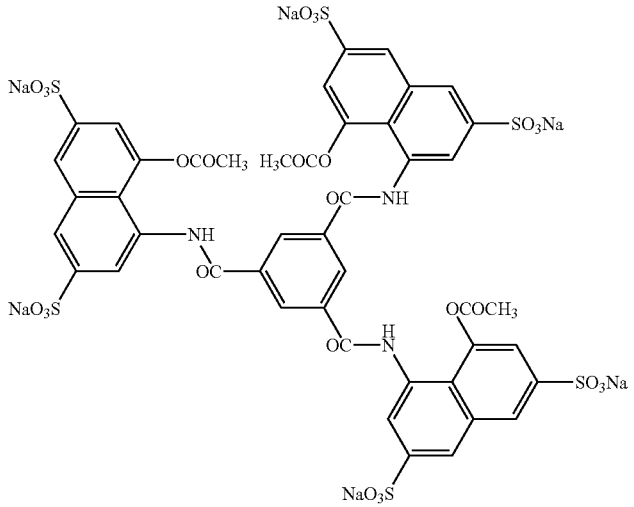
II-18)
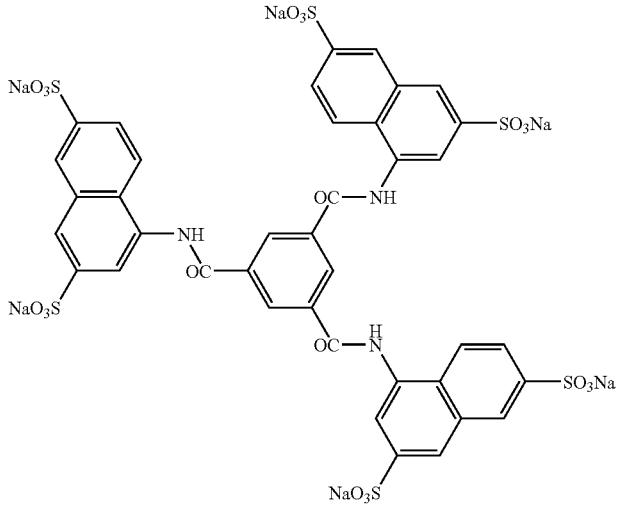
II-19)
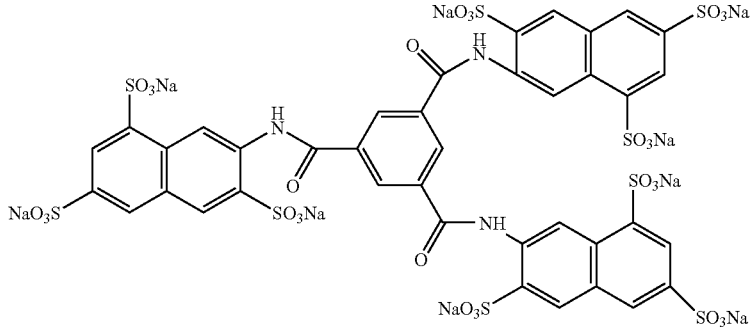

-continued

II-20)

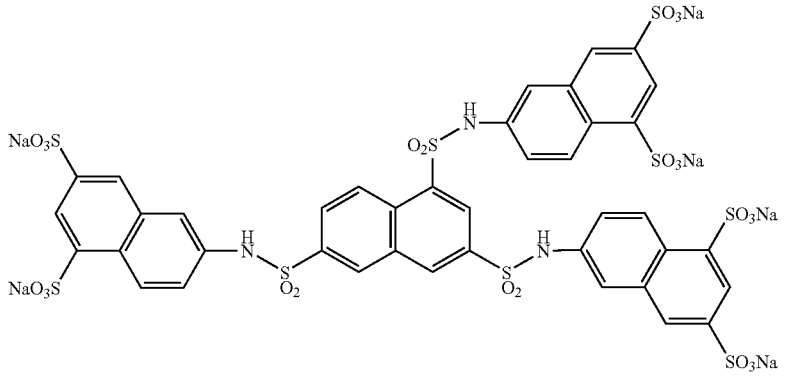

When the compound for use in the present invention has a plurality of asymmetric carbons in the molecule thereof, a single structure thereof has a plurality of stereoisomers. The present invention includes all possible stereoisomers. In the present invention, only one of the plural stereoisomers may be used, or two or more thereof may be used as a mixture.

The compound for use in the present invention can be synthesized by the synthesis method described in WO97/19916, or a method according to the synthesis method, but the invention is not limited to those.

The compound for use in the present invention may be used singly or in combination of two or more kinds thereof. The number of compounds to be used and a kind of the processing composition to contain the compound(s) can be selected appropriately. The compound for use in the present invention may be used together with any method(s) for reducing color-remains or any compound(s) having an effect of reducing color-remains outside the scope of the present invention. The method to be used, the number of compounds to be contained, or the kind of the processing composition to be used at this time may also be selected appropriately.

For example, a bis(triazinylamino)stylbenedisulfonic acid compound, which can be used together with the compound for use in the present invention, may be a known or commercially available diaminostylbene-based fluorescent bleaching agent. Preferred examples of the known bis(triazinyldiamino)stylbenedisulfonic acid compound are described in, for example, JP-A-6-329936, JP-A-7-140625, JP-A-10-104809, and JP-A-2001-281823. The commercially available compounds are described in, for example, "Senshoku Note (Notebook on Dyeing)", 19th edition (Shikisensha Co., Ltd.), pp. 165 to 168. Among the products described in this publication, Blankophor BSUliq, Blankophor REU, Tinopal MSP, and Hakkol BRK (each trade names) are preferred. Compounds described in JP-A-3-73948 or U.S. Pat. No. 6,153,364 may be used together.

Next, the processing composition in the present invention will be described in detail. In the present invention, the term "processing composition" means a processing composition to be used in the process for performing image formation with a silver halide color photographic photosensitive material. Specific examples thereof include a color-development composition, a bleaching composition, a bleach-fixing composition, a fixing composition, a washing composition and a stabilizing composition. Furthermore, the processing composition may be a black-and-white development composition, a reversal composition and a pre-bleaching composition. These processing compositions may be prepared as tank solutions or replenishers in working solution concentrations, or as concentrated solutions. When the processing composition of the present invention is a concentrated solution, it is mixed with water in a predetermined ratio when in use, and employed as a replenisher or a tank solution. The compound for use in the present invention is characterized by having excellent stability without causing deposition, in a composition being in a state of solution. However, the compound for use in the present invention can also be used in processing compositions of various forms, such as granules, tablets, powder or slurry.

The composition of the present invention may be an additive composition. The additive composition means a composition which is added to a processing solution, that is a working solution or a replenisher, required for processing for forming an image with a silver halide color photographic light-sensitive material before or during the processing, and which has a function for adjusting photographic performances. The working solution is a processing solution in a processing tank, and the replenisher is a processing solution added to the working solution dependently on the amount to be processed of the photosensitive material.

In the processing composition of the present invention, the concentration of the compound represented by formula (I) or the compound represented by formula (II) in a working solution is preferably 0.01 to 20 mmol/l, more preferably 0.02 to 20 mmol/l, further preferably 0.02 to 10 mmol/l, still further preferably 0.05 to 10 mmol/l, and still more further preferably 0.05 to 5 mmol/l. When the processing composition of the present invention is an additive composition, it is added to a working solution or a replenisher such that the concentration of the compound for use in the present invention contained in the composition would be within the above concentration range. Further, when the processing composition of the present invention is used after diluted with water or another processing composition, the concentration of the compound(s) in the processing composition is expressed as a value obtained by multiplying the concentration of the compound(s) in the working solution by a concentration factor. The wording "concentration factor" in the present specification has a meaning of the ratio between the concentration of a component in a processing composition and the concentration of the component in a processing solution to be used, as is ordinarily used in the art.

In the image-forming method applied according to the present invention, is used the processing composition of the present invention in at least one processing step. The processing composition of the invention may be used in a plurality of processing steps or in all the processing steps.

The processing composition of the present invention can be prepared by various preparation methods. Among them, the following three methods give good results. However, in implementing the present invention, the production method for the processing composition is not limited to the following three methods.

[Method A] A method in which a small amount of water is introduced into a mixing tank in advance, and then constituent chemicals are sequentially charged thereinto while stirring.

[Method B] A method in which constituent chemicals are mixed in a mixing tank in advance, and then a small amount of water is charged to the tank at one time.

[Method C] A method in which constituent chemicals are divided into appropriate groups in advance, and each group is dissolved in water or a hydrophilic organic solvent to form a concentrated solution, and the thus-obtained concentrated solutions are mixed.

Alternatively, production methods which partially incorporating the above-mentioned methods may also be employed.

Next, the following each composition will be described on the cases where the processing composition of the present invention is any one of a development composition, a bleaching composition, a bleach-fixing composition, a fixing composition, a washing composition, a stabilizing composition, or an additive composition.

When the photographic processing composition of the present invention is in an embodiment of a color-development composition, the color-development composition contains a color-developing agent. The color-developing agent is preferably an aromatic primary amine color-developing agent, and particularly preferably a p-phenylenediamine derivative. Hereinafter, representative examples thereof will be shown, but the present invention should not be considered to be limited thereto. In addition, in recent years, some black-and-white photosensitive materials contain a coupler for forming black color, to form a black-and-white image, using a general-purpose color-developer. The processing composition of the present invention can also be applied for processing this type of photosensitive materials.

1) N,N-diethyl-p-phenylenediamine
2) 4-amino-N,N-diethyl-3-methylaniline
3) 4-amino-N-(β-hydroxyethyl)-N-methylaniline
4) 4-amino-N-ethyl-N-(β-hydroxyethyl)aniline
5) 4-amino-N-ethyl-N-(β-hydroxyethyl)-3-methylaniline
6) 4-amino-N-ethyl-N-(3-hydroxypropyl)-3-methylaniline
7) 4-amino-N-ethyl-N-(4-hydroxybutyl)-3-methylaniline
8) 4-amino-N-ethyl-N-(β-methanesulfonamidoethyl)-3-methylaniline
9) 4-amino-N,N-diethyl-3-(β-hydroxyethyl)aniline
10) 4-amino-N-ethyl-N-(β-methoxyethyl)-3-methylaniline
11) 4-amino-N-(β-ethoxyethyl)-N-ethyl-3-methylaniline
12) 4-amino-N-(3-carbamoylpropyl)-N-n-propyl-3-methylaniline
13) 4-amino-N-(4-carbamoylbutyl)-N-n-propyl-3-methylaniline
14) N-(4-amino-3-methylphenyl)-3-hydroxypyrrolidine
15) N-(4-amino-3-methylphenyl)-3-hydroxymethylpyrrolidine
16) N-(4-amino-3-methylphenyl)-3-pyrrolidinecarboxamide Among the p-phenylenediamine derivatives described above, exemplified compounds 5), 6), 7), 8) and 12) are preferred, with 5) or 8) being particularly preferred. These p-phenylenediamine derivatives each are generally in the form of a sulfate, a hydrochroride, a p-toluenesulfonate, a naphthalenedisulfonate, an N,N-bis(sulfonatoethyl) hydroxylamine, in a solid state. Alternatively, the derivative may be added as a free form having no counter salt. The concentration of the aromatic primary amine developing agent in a working solution is preferably 4 to 100 mmol/l, more preferably 6 to 50 mmol/l, and further preferably 8 to 25 mmol/l.

A compound that prevents deposition of the color-developing agent may be added to the color developer. Examples thereof include polyethylene glycols, arylsulfonic acids, alkylsulfonic acids, and the urea compounds described in JP-A-11-174643. Among these, particularly preferred are those compounds that give particularly less influence on photographic properties and exhibit good effects, such as diethylene glycol, polyethylene glycol 300, p-toluenesulfonic acid and its salt, a linear alkylsulfonic acid having 5 to 9 carbon atoms or its salts, and ethylene urea.

The color-development composition preferably contains a compound that prevents deterioration by air oxidation of a color developing agent, i.e., a preservative. As an inorganic preservative, sulfites and hydroxylamine are preferred. They exhibit significant preserving action. Also, it is preferred that the inorganic preservative is used in combination with an organic preservative. In some cases, depending on the objective photosensitive material, sulfites and hydroxylamine may give an undesirable influence on the photographic properties in the process of color-development. Therefore, the color-development composition may contain only one of the sulfites and hydroxylamine in one case, or it may contain substantially none of them and contains only an organic preservative in another case.

As the organic preservative, hydroxylamine derivatives, hydroxam acids, hydrazides, phenols, α-hydroxyketones, α-aminoketones, saccharides, monoamines, diamines, polyamines, quaternary ammoniums, nitroxy radicals, alcohols, oximes, diamides, condensed ring-type amines, cyclic amides, salicylic acids, polyethyleneimines, alkanolamines, and aromatic polyhydroxy compounds are effective. Among the above-mentioned organic preservatives, those hydroxylamine derivatives described in JP-A-3-56456 and JP-A-3-33845 and those compounds described in JP-A-3-33846 and JP-A-6-148841 are particularly preferred.

Preferably, a hydroxylamine derivative is used in combination with an alkanolamine, in consideration of improvement in stability of the color developer in continuous processing. The compounds that are particularly preferred for combined use with a hydroxylamine include triisopropanolamine and triethanolamine. Also, combined use with a cyclic amide compound is also preferable. Among cyclic amide compounds, ε-caprolactam is particularly preferred.

The pH of the color-development composition is preferably 9.5 to 13.5. The color developer prepared therefrom generally has pH of 9.0 to 12.2, and preferably pH of 9.9 to 11.2. To maintain the pH, it is preferred to add a buffer to the color developer. As the buffer, potassium or sodium salts of inorganic salts such as carbonates, hydrogen carbonates, phosphates, borates, and tetraborates are preferred. Also, organic compounds such as 5-sulfosalicylic acid, β-alanine, proline, and tris(hydroxyamino)methane can also be preferably used. However, the present invention should not be considered to be limited to these compounds. Preferably, the above buffer is added so that, for example, the concentration of the above-mentioned buffer in a color-developer replenisher becomes 0.1 mol/l or more, and more preferably 0.1 to 0.4 mol/l.

The color-development composition may contain various chelating agents, which are precipitation inhibitors for calcium, magnesium, and the like. The chelating agents may be used singly or in combination of two or more of them. Preferred compounds as the chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, ethylenediaminesuccinic acid (s,s-form), 2-phosphonobutane-1,2,4-tricarboxylic acid, 1-hydroxyethylidene-1,1-diphosphonic acid, 1,2-dihydroxybenzene-4,6-disulfonic acid, and the like. It is enough to add the chelating agent to a developer in an amount that is enough to mask metal ions in the color developer. Generally, the chelating agent is added so that its concentration becomes about 0.1 g/L to 10 g/L.

An arbitrary development accelerator may be added to the color-development composition, if necessary. Examples of the development accelerator include polyalkylene oxides, 1-phenyl-3-pyrazolidones, alcohols, carboxylic acids, and the like.

An arbitrary antifoggant may be added to the color-development composition, if necessary. Examples of the antifoggant include metal halides such as sodium chloride, potassium bromide, and potassium iodide, and organic antifoggants represented by nitrogen-containing heterocyclic compounds. Examples of the organic antifoggant include benzotriazole, 6-nitrobenzimidazole, 5-nitroisoindazole, 5-methylbenzotriazole, 5-nitrobenzotriazole, 5-chlorobenzotriazole, 2-thiazolylbenzoimidazole, 2-thiazolylmethylbenzoimidazole, indazole, hydroxyazaindolizine, adenine, and the like. Besides these, alkylcarboxylic acids, arylcarboxylic acids and succharides may be added, if necessary.

Color development in which the present invention is applied to as a color-development composition, is carried out under the following conditions. In the case of color print photosensitive materials, the processing temperature is preferably 30 to 55° C., more preferably 35 to 50° C., and particularly preferably 38 to 45° C. The developing time is preferably 5 to 90 seconds, more preferably 8 to 60 seconds, and particularly preferably 10 to 45 seconds. Smaller replenisher volumes are preferred, and the replenisher volume is preferably 15 to 200 ml, more preferably 20 to 120 ml, and particularly preferably 30 to 60 ml, per $m^2$ of the photosensitive material to be processed.

In the case of color negative films, the processing temperature is preferably 30 to 55° C., more preferably 35 to 50° C., and particularly preferably 38 to 45° C. The developing time is preferably 45 seconds to 5 minutes, more preferably 60 seconds to 4 minutes, and particularly preferably 90 seconds to 3 minutes and 15 seconds. Smaller replenisher volumes are preferred, and the replenisher volume is preferably 10 to 200 ml, more preferably 12 to 60 ml, and particularly preferably 15 to 30 ml, per a 24-exposure film (hereinafter, abbreviated to as "24 exp.").

In the case of color reversal films, the processing temperature is preferably 32 to 45° C., more preferably 35 to 40° C., and particularly preferably 36.5 to 39.5° C. The developing time is preferably 4 to 8 minutes, more preferably 5 to 7 minutes, and particularly preferably 5 minutes and 30 seconds to 6 minutes and 30 seconds. Smaller replenisher volumes are preferred, and the replenisher volume is preferably 1000 to 3000 ml, more preferably 1500 to 2800 ml, and particularly preferably 2000 to 2400 ml, per $m^2$ of the photosensitive material to be processed.

The color-development compositions obtained by concentrating the replenishers described in JP-A-11-174643, JP-A-11-194461, and JP-A-11-194462 are examples of a preferred mode of the photographic processing composition of the present invention.

When the photographic processing composition of the present invention is in an embodiment of a bleaching composition or a blix composition, as a bleaching agent to be contained in the bleaching composition or bleach-fixing composition, use can be made of an arbitrary bleaching agent. In particular, organic complex salts of iron (III) (for example, complex salts of an aminopolycarboxylic acid or of an organic acid such as citric acid, tartaric acid, and malic acid), persulfates, hydrogen peroxide, and the like are preferred. A mixture of two or more bleaching agents may be used.

Among these, organic complex salts of iron (III) are particularly preferred from the viewpoint of rapid processability and prevention of environmental pollution. Examples of aminopolycarboxylic acid or its salts useful for forming organic complex salts of iron (III) include such compounds as, ethylenediaminesuccinic acid (s,s-form), N-(2-carboxylatoethyl)-L-aspartic acid, β-alaninediacetic acid, and methyliminodiacetic acid, which are all biodegradable, as well as ethylenediaminetetraacetic acid, diethylenetriaminepentaacetic acid, 1,3-propylenediaminetetraacetic acid, nitrilotriacetic acid, cyclohexanediaminetetraacetic acid, iminodiacetic acid, glycol ether diamine tetraacetic acid and the like. These compounds may be any one of sodium, potassium, lithium or ammonium salts. Among these compounds, ethylenediaminesuccinic acid (s,s-form), N-(2-carboxylatoethyl)-L-aspartic acid, β-alaninediacetic acid, and methyliminodiacetic acid, as well as ethylenediaminetetraacetic acid, diethylenetriaminepentaacetic acid, and 1,3-propylenediaminetetraacetic acid are preferable since the resulting iron (III) salt has good effects on photographic properties. The above ferric ion complex salts may be used in the form of a complex salt. Alternatively, a ferric iron salt, for example, ferric sulfate, ferric chloride, ferric nitrate, ferric ammonium nitrate, ferric phosphate, or the like and a chelating agent such as aminopolycarboxylic acid may be mixed to form a ferric iron ion complex salt in a solution. Alternatively, a chelating agent may be used in an excessive amount that is more than what is necessary for forming a ferric iron complex salt. The concentration of a bleaching agent in a working solution of a bleaching solution or bleach-fixing solution is preferably 0.01 to 1.0 mol/l, more preferably 0.05 to 0.5 mol/l, and particularly preferably 0.1 to 0.5 mol/l.

It is also preferred that a buffer is added to the bleaching solution or bleach-fixing solution. The buffer is selected according to intended pH values. Preferred examples of a compound suitable as a buffer include organic acids such as succinic acid, maleic acid, glycolic acid, malonic acid, fumaric acid, succinic acid, sulfosuccinic acid, and acetic acid; organic bases such as imidazole and dimethylimidazole; compounds represented by the formula (A-a) or (B-b) described in JP-A-9-211819. The addition amount of these compounds in a working solution is preferably 0.005 to 3.0 mol/l, and more preferably 0.05 to 1.5 mol/l. The pH range of the bleaching solution is preferably pH 2 to 7, and particularly preferably pH 3 to 6. In the case of the bleach-fixing solution, the pH range is preferably pH 3 to 8, and more preferably 4 to 7.

In bleach-fixing of color print photosensitive materials applied to the present invention, the processing temperature is preferably 30 to 55° C., more preferably 35 to 50° C., and particularly preferably 38 to 45° C. The bleach-fixing time is preferably 5 to 90 seconds, more preferably 8 to 60 seconds, and particularly preferably 10 to 45 seconds.

Smaller replenisher volumes are preferred, and the replenisher volume is preferably 20 to 200 mL, more preferably 25 to 120 mL, and particularly preferably 30 to 50 mL, per $m^2$ of the photosensitive material to be processed.

In bleaching of color negative films, the processing temperature is preferably 30 to 55° C., more preferably 35 to 50° C., and particularly preferably 38 to 45° C. The bleaching time is preferably 12 seconds to 2 minutes, more preferably 15 seconds to 1 minute and 15 seconds, and particularly preferably 18 to 60 seconds. Smaller replenisher volumes are preferred, and the replenisher volume for one 24-exp. film is preferably 2.5 to 50 mL, more preferably 3 to 25 ml, and particularly preferably 4 to 12 mL.

In bleaching of color reversal films, the processing temperature is preferably 30 to 45° C., more preferably 33 to 40° C., and particularly preferably 37 to 39° C. The bleaching time is preferably 4 to 8 minutes, more preferably 5 to 7 minutes, and particularly preferably 5 minutes and 30 seconds to 6 minutes and 30 seconds. Smaller replenisher volumes are preferred, and the replenisher volume is preferably 160 to 400 mL, more preferably 180 to 300 mL, and particularly preferably 200 to 250 ml, per $m^2$ of the photosensitive material to be processed.

When the photographic processing composition of the present invention is in an embodiment of a bleach-fixing composition or a fixing composition, as a fixing agent to be used in the composition, use can be made of an arbitrary fixing agent. Examples of the fixing agent include thiosulfates, such as sodium thiosulfate and ammonium thiosulfate; thiocyanates, such as sodium thiocyanates and ammonium thiocyanate; ethylenebisglycolic acid, 3,6-dithia-1,8-octanediol, thioureas, thioether compounds described in JP-A-4-317055; and water-soluble silver halide solubilizing agents, such as mesoionic compounds described in JP-A-4-143757 and JP-A-4-230749. These fixing agents may be used singly, or two or more of them may be used as a mixture. As the fixing agent, use of thiosulfates, in particular ammonium thiosulfate, is preferred. The concentration of fixing agent in the fixing solution or bleach-fixing solution is preferably 0.3 to 2 mol/L, and-more preferably 0.5 to 1.5 mol/L.

It is preferred that a buffer is added to the bleach-fixing composition or fixing composition. Preferred examples of the buffer include heterocyclic organic bases, such as imidazole and dimethylimidazole; aminoalkylenesulfonic acids, such as taurine; and dibasic acids, such as succinic acid, maleic acid and malonic acid. The pH of the above composition of the present invention is preferably 3 to 8, and more preferably 4 to 7.

The bleach-fixing composition or the fixing composition preferably contains a compound that releases a sulfite ion, i.e., sulfites, bisulfites, metabisulfites, and the like, as a preservative. Preferably, these compounds are added in the form of potassium salts, sodium salts or ammonium salts. It is also preferred that the composition contains an arylsulfinic acid, such as p-toluenesulfinic acid, m-carboxybenzenesulfinic acid, and p-aminobenzenesulfinic acid. Preferably, a working solution contains these compounds in an amount of 0.02 to 1.0 mol/L. As the preservative, besides the above-mentioned ones, ascorbic acid, carbonyl bisulfite adducts or a carbonyl compound may also be added.

For improving image preservability, the bleach-fixing composition or the fixing composition may contain mercapto nitrogen-containing heterocyclic compounds, such as mercaptotriazole, aminomercaptotriazole, and N-methylmercaptoimidazole, that form stable silver ions; and monoamidines or bisguanidines and bisamidines as described in JP-A-5-303185, which accelerate washing-off of the developing agent. In addition, the bleach-fixing composition or the fixing composition of the present invention may contain polymers, such as polyethylene glycol and polyvinylpyrrolidone, chelating agents, antifoaming agents, mildewproofing agents, and the like, if necessary.

In bleach-fixing of color print photosensitive material applied to the present invention, the processing temperature, bleach-fixing time, and replenisher volume are as described above. In fixing color negative films, the processing temperature is preferably 30 to 55° C., more preferably 35 to 50° C., and particularly preferably 38 to 45° C. The bleaching time is preferably 20 seconds to 2 minutes, more preferably 30 seconds to 1 minute and 40 seconds, and particularly preferably 35 seconds to 1 minute and 20 seconds. Smaller replenisher volumes are preferred, and the replenisher volume for one 24-exp. film is preferably 4 to 60 mL, more preferably 5 to 40 mL, and particularly preferably 6 to 30 mL.

In fixing color reversal films, the processing temperature is preferably 30 to 45° C., more preferably 33 to 40° C., and particularly preferably 37 to 39° C. The fixing time is preferably 2 to 6 minutes, more preferably 3 to 5 minutes, and particularly preferably 3 minutes and 30 seconds to 4 minutes and 30 seconds. Smaller replenisher volumes are preferred, and the replenisher volume is preferably 800 to 2000 mL, more preferably 900 to 1500 mL, and particularly preferably 1000 to 1250 mL, per $m^2$ of the photosensitive material to be processed.

When the photographic processing composition of the present invention is in an embodiment of a washing composition or a stabilizing composition, to the composition, may be added formalin, acetaldehyde, pyruvic aldehyde, a formaldehyde bisulfite adduct described in U.S. Pat. No. 4,921,779, or an N-methylol compound described in JP-A-5-34889, for the purpose to prevent generation of stain or color fading of a dye, due to a remaining magenta coupler. Also, it is preferred that the composition contains an arylsulfinic acid such as p-toluenesulfinic acid, m-carboxybenzenesulfinic acid, and p-aminobenzenesulfinic acid. The composition may also contain a surfactant as a drainage agent, a chelating agent as a hard water softener, a buffer for adjusting pH, an antifoam agent, a mildewproofing agent, a microbicide, and the like, if necessary.

A preferred pH is 4 to 10, and more preferably 5 to 8. The temperature may be set variously depending on the purpose, properties and the like of photosensitive materials. Generally, it is 20 to 50° C., and preferably 25 to 45° C.

When the photographic processing composition of the present invention is in an embodiment of an additive composition, the additive composition is preferably composed of the compound represented by formula (I) and water. If necessary, to the additive composition, may be added a water-soluble aliphatic compound, a bis (triazinylamino)stylbenedisulfonic acid compound, a chelating agent, an inorganic salt, or the like. Examples of preferred compounds as the water-soluble aliphatic compound include glycols, such as diethylene glycol and polyethylene glycol 300; and alkanolamines, such as triethanolamine and triisopropanolamine. Diethylene glycol is particularly preferable. The additive composition of the present invention may be added to any one of processing baths or replenishers which are necessary for processing for forming an image using a silver halide color photographic photosensitive material. In the additive composition, the compound for use in the present invention is preferably present with being concentrated. The concentration factor thereof to a working solution is generally from 50 to 4000 times, preferably from 100 to 2000 times, and more preferably from 200 to 1000 times. In a preferred embodiment, the additive composition of the present invention is added to a fixing bath and/or a fixing replenisher in color reversal processing, but the present invention is not limited to this embodiment.

The water-soluble aliphatic compound that can be used in the additive composition of the present invention will be described. The water-soluble aliphatic compound causes an improvement in the storage stability of the compound represented by formula (I). The water-soluble aliphatic compound may be used singly or in combination of a plurality of the compounds. The molecular mass of the water-soluble aliphatic compound is generally less than 200, preferably from 50 to less than 200, more preferably from 80 to 180, and further preferably from 100 to 150. The water-soluble aliphatic compound has preferably 2 to 10 carbon atoms, more preferably 2 to 6 carbon atoms, and further preferably 4 to 6 carbon atoms. The aliphatic compound that can be used in the present invention preferably has at least two nitrogen atoms or oxygen atoms, or has at least one nitrogen atom and at least one oxygen atom. The aliphatic compound that can be used in the present invention also preferably has at least two amino groups or hydroxyl groups, or at least one amino group and at least one hydroxyl group.

Specific examples of the water-soluble aliphatic compound include glycols, such as ethylene glycol, diethylene glycol and triethylene glycol; alkanolamines, such as diethanolamine, triethanolamine and triisopropanolamine; and polyols, such as glycerin. Among these, preferred are diethylene glycol, triethanolamine and triisopropanolamine. Particularly preferred is diethylene glycol.

The amount to be added of the water-soluble aliphatic compound in the additive composition of the present invention is generally 0.5 mole or more per mole of the compound represented by formula (I), preferably from 0.5 to 200 moles, more preferably from 2 to 150 moles, and further preferably from 10 to 100 moles per mole of the compound represented by formula (I).

The additive composition of the present invention can be used in any conventionally-known processing process and any conventionally-known processing composition, for processing a photographic element, such as a color reversal film, a color negative film or a color print material. Typical processing processes are described in, for example, Research Disclosures (hereinafter, abbreviated to "RD"). Specific examples of the processing processes are described in, for example, RD No. 17643, RD No. 308119 and RD No. 38957. Typical examples of the processing composition include processing compositions described on pages 28 to 32 in JP-A-2001-281823.

Specific examples of the processing process include processes called the following names: Process E-6 according to Eastman Kodak, Process CR-56 according to Fuji Photo Film Co., Ltd., and Process Pro 6 according to Fuji Hunt Co., in the case of color reversal films; Process C-41 and Process ECN-2 according to Eastman Kodak, Process CN-16 according to Fuji Photo Film Co., Ltd., Process AP70 according to AGFA, and Process CNK-4 according to Konica Co., in the case of color negative films; and Process RA-4 according to Eastman Kodak, Processes CP-48S, CP-47L, CP-45X, CP-43FA and CP-40FA according to Fuji Photo Film Co., Ltd., and Process AP94 according to AGFA, in the case of color print materials, but the processing process that can be used in the present invention is not limited to these examples.

The photographic element, as a photosensitive material, to be processed with the photographic processing composition of the present invention may contain any one of ordinary silver halides, for example, silver chloride, silver bromide, silver bromoiodide, silver chlorobromide, silver chloroiodide, and mixtures thereof. In one embodiment, this photographic element is a high silver chloride element containing 50% by mole or more of a chloride, preferably 90% by mole or more of a chloride. For example, this element is used in many cases as a color print photosensitive material.

In another embodiment, at least one emulsion is composed mainly of silver bromide (50% by mole or more of silver bromide). Most preferably, this photographic element has one or more color recording element. The color recording element or each of the color recording elements comprises one or more of silver halide emulsions made mainly of silver bromide, as are used in a color negative film or a color reversal film. The photographic element processed by carrying out the present invention can be a monochromic element or a multicolor element. The element can also have a magnetic recording layer known in the art.

Details of each photographic element are described in, for example, RD No. 17643, pages 23 to 27; RD No. 18716, pages 647 to 650; RD No. 307105, pages 866 to 868 and 873 to 879; and RD No. 36544, pages 501 to 541. These are related to useful (negative-type or positive-type) silver halide emulsions and methods of preparing the same, various types of sensitizers, dye-forming couplers, image-dye stabilizers, dyes, ultraviolet absorbers, filters, binders, film-hardening agents, plasticizers, lubricants, coating auxiliaries, surfactants, antistatic agents, mat agents, and paper or film supports, and various image-forming methods of negative image- or positive image-forming color elements. As a spectral sensitizing dye or a supersenstizer, any one may be used. Examples thereof are described in the above-mentioned RDs.

Specifically, preferred examples of a commercially available color reversal film to which the present invention can be applied, include FUJICHROME Color Reversal Film (trade name, manufactured by Fuji Photo Film Co., Ltd.), FUJICHROME duplicating Film (trade name, manufactured by Fuji Photo Film Co., Ltd.), EKTACHROME Color Reversal Film (trade name, manufactured by Eastman Kodak), AGFACHROME Color Reversal Film (trade name, manufactured by AGFA), and KONICACHROME Color Reversal Film (trade name, manufactured by Konica Co.), but in the present invention the color reversal film is not limited to these products.

Preferred examples of a commercially available color negative film to which the present invention can be applied, include FUJICOLOR SUPERIA Film, FUJICOLOR REALA ACE Film, FUJICOLOR nexia Film, FUJICOLOR 160 Film, and FUJICOLOR PRO Film (each trade name, manufactured by Fuji Photo Film Co., Ltd.); Kodak GOLD Film, Kodak GOLD MAX Film, Kodak MAX beauty Film, Kodak ROYAL GOLD Film, and Kodak ADVANTiX Film (each trade name, manufactured by Eastman Kodak); AGFACOLOR vista Film, and AGFACOLOR FuturaII Film (each trade name, manufactured by AGFA); and KONICACOLOR CENTURIA Film, KONICACOLOR New CENTURIA Film, and KONICACOLOR centuria APS Film (each trade name, manufactured by Konica Co.), but in the present invention the color negative film is not limited to these products. The present invention can be applied to a photographic material for shooting commercially available as a "single use camera".

Preferable examples of a commercially available color print material to which the present invention can be applied, include FUJICOLOR Crystal Archive Paper, and FUJICOLOR SUPER FA Paper (each trade name, manufactured by Fuji Photo Film Co., Ltd.); Kodak EKTACOLOR EDGE Paper, and Kodak EKTACOLOR Royal Paper (each trade name, manufactured by Eastman Kodak); AGFACOLOR TYPE Paper, and AGFACOLOR Prestige Paper (each trade name, manufactured by AGFA); and KONICACOLOR QA Paper (trade name, manufactured by Konica Co.), but in the present invention the color print material is not limited to these products.

The processing composition of the present invention is advantageously formulated into a form that contains all the components to be contained in a working solution, in a single composition, i.e., a one-pack constitution. However, in the case where it is undesirable to allow the components being contacting with each other for a long period of time, in a color-development composition, bleach-fixing composition or the like, the components may be divided into two or more liquid agents, thereby forming a two-pack or three-pack constitution processing composition. These are usually called 1-, 2- and 3-part constitutions, respectively, according to the naming by international standard ISO 5989. The processing composition of the present invention do not lose the effects or characteristics of the invention by dividing the composition into some parts. Among the constituents, 1-part constitution is particularly preferable for the color-development composition.

For a container for the processing composition of the present invention, known materials appropriate for the content can be used. The container may be made of a single material or a composite material, for example, a composite material of a material having a high gas permeability and a material having a high alkali stability. From the viewpoint of reuse and recyclability, it is preferred that the container is composed of a single raw material. Examples of the material to be used for the container include polyester resins, polyolefin resins, acrylic resins, ABS resins, epoxy resins, polyamide resins including nylons, polyurethane resins, polystyrene resins, polycarbonate resins, PVA (polyvinyl alcohols), polyvinyl chlorides, polyvinylidene chlorides, polyethylene resins, and the like. Among them, polyester resins, such as polyethylene terephthalate and polyethylene naphthalate, and polyolefin resins, such as polyethylenes and polypropylenes, are preferred when a container is made of a single material selected therefrom. Of these, polyethylene resins are preferred, with high-density polyethylene (HDPE) resins being further preferred as a container material.

To the container material that can be used in the present invention, carbon black, titanium white, a pigment, calcium carbonate, a plasticizer having compatibility with the material, and the like may be added, so far as they do not affect the processing composition. Preferably, the container material is one which has a ratio of polyethylene in the material of 85% by mass or more and contains no plasticizer, more preferably one which has a ratio of polyethylene in the material of 95% by mass or more and contains no plasticizer.

The shape and structure of the container for packing the processing composition of the present invention may be designed arbitrary depending on the purpose. In addition to a standard bottle, the container with a telescopic type as described in JP-A-1-235950, the container with a flexible partition wall as described in JP-A-62-134626, and the like may also be used. The container described in JP-A-11-282148 is particularly preferred as a container for the processing composition of the present invention, from the viewpoints of capacity, space efficiency, self-supporting property, and form retention as well as easiness in reuse and recycling. A kit according to one preferred embodiment of the present invention includes a single cartridge having incorporated therein a plurality of containers made of a single material and having the same shape and volume, in which a corresponding plurality of kinds of the processing compositions of the present invention are filled, respectively. One example is the cartridge described in JP-A-2000-3014. In the present invention, any desired combination of the processing compositions in a cartridge may be selected. A preferred embodiment is a cartridge in which a development composition, a bleaching composition and a fixing composition are incorporated therein as described in JP-A-11-295858 or JP-A-11-288068.

According to the photographic processing composition of the present invention, it is possible to decrease stain (color-remains), resulting from a sensitizing dye remaining in a photographic photosensitive material. Additionally, according to the photographic processing composition of the present invention, the above-mentioned color-remains decreasing effect can be kept stable even after the composition is stored.

According to the image-forming method of the present invention, it is possible to obtain an image with decreased stain (color-remains), resulting from a sensitizing dye remaining in a photographic photosensitive material. Further, according to the processing method of the present invention, the above-mentioned color-remains decreasing effect can be kept stable even after the photographic processing composition is stored.

According to the present invention, it is possible to provide a photographic processing composition that provides reduced stain (color-remains), resulting from a synthesizing dye remaining in a photographic photosensitive material after processing. Further, according to the present invention, it is possible to provide a processing composition for a silver halide color photographic photosensitive material that can keep the effect of decreasing color-remains stable, as any kind of processing composition. Further, according to the present invention, it is possible to provide a method for decreasing stain, resulting from a sensitizing dye remaining in a silver halide color photographic photosensitive material after processing; and an image-forming method with a silver halide color photographic photosensitive material, using the above method.

Hereinafter, the present invention will be described in more detail by way of examples, but the present invention should not be limited thereto.

EXAMPLES

Synthetic Example 1

Synthesis of Exemplary Compound I-8)

A disodium salt of amino J acid (11.4 g) and sodium acetate (3.6 g) were dissolved into water (30 mL), and thereto was added a solution (25 mL) wherein isophthalic acid chloride (3.0 g) and polyoxyethylene polyoxypropylene glycol (10 mg) were dissolved in toluene. The resulting mixture was vigorously stirred at room temperature for 2 hours. After the reaction, the resultant reaction mixture was allowed to stand still, and then the aqueous phase thereof was taken out. Thereto was added ethyl alcohol (90 mL) under stirring. After the solution was stirred for 1 hour, the resultant precipitation was filtrated, washed with ethanol and dried, to yield 11.7 g of the exemplary compound I-8).

Synthetic Example 2

Synthesis of Exemplary Compound I-41)

A monosodium salt of amino R acid (11.8 g) and sodium acetate (5.1 g) were dissolved into water (90 mL), and thereto was added a solution (30 mL) wherein isophthalic acid chloride (3.0 g) and polyoxyethylene polyoxypropylene glycol (10 mg) were dissolved in toluene. The resulting mixture was vigorously stirred at room temperature for 5 hours. After the reaction, the resulting reaction mixture was stirred under cooling with ice for 2 hours. After the stirring, the resultant precipitation was filtrated, washed with methanol, and dried, to yield 10.2 g of the exemplary compound I-41).

Example 1

(1) Preparation of a fixing composition

| | |
|---|---|
| Ammonium thiosulfate (75% by mass) | 80 g |
| Sodium sulfite | 5.0 g |
| Sodium bisulfite | 5.0 g |
| Compound for use in the present invention represented by the formula (I) or (II), or Compound for comparison (see Table 1 below) | 0.25 mM |
| Water to make the total volume to | 1000 mL |
| pH (adjusted with acetic acid and aqueous ammonia at 25° C.) | 6.60 |

(2) Development processing

| Processing Step | Processing composition | Temperature | Time (min.) |
|---|---|---|---|
| First development | Fujichrome Film first development replenisher CR-56P H1-R, and Fujichrome Film first development starter CR-56P H1-S (each trade name, manufactured by Fuji Photo Film Co., Ltd.) | 38.0° C. | 6 |
| First water washing | Water | 38.0° C. | 2 |
| Reversal | Fujichrome Film reversal bath liquid/replenisher CR-56P H2/H2-R (each trade name, manufactured by Fuji Photo Film Co., Ltd.) | 38.0° C. | 2 |
| Color development | Fujichrome Film color development replenisher CR-56P H3-R parts A and B, and Fujichrome Film color development starter CR-56P H3-S (each trade name, manufactured by Fuji Photo Film Co., Ltd.) | 38.0° C. | 6 |
| Pre-bleaching | Fujichrome adjustor/replenisher CR-56P H4/H4-R (each trade name, manufactured by Fuji Photo Film Co., Ltd.) | 38.0° C. | 2 |
| Bleaching | Fujichrome Film bleaching replenisher CR-56P H5-R, and Fujichrome bleaching starter CR-56P H5-S (each trade name, manufactured by Fuji Photo Film Co., Ltd.) | 38.0° C. | 6 |
| Fixing | The fixing composition prepared in the above (1) | 38.0° C. | 4 |
| Second water washing | Water | 38.0° C. | 6 |
| Final rinse | Fujichrome stabilizer/replenisher CR-56P H7/H7-R (each trade name, manufactured by Fuji Photo Film Co., Ltd.) | 25.0° C. | 1 |

Respective processing chemicals of Process CR-56P, manufactured by Fuji Photo Film Co., Ltd., were used in the first development, reversal, color development, bleaching, and final rinse. According to the methods for adjusting the chemicals, respective tank solutions were prepared. The development processing was performed according to the processing specification of Process CR-56P (trade name), manufactured by Fuji Photo Film Co., Ltd., in a manner in which samples were carried while being hung from a hanger.

(3) Evaluation

A photosensitive material sample: Fujichrome VELVIA (trade name), manufactured by Fuji Photo Film Co., Ltd., was subjected to light-exposure corresponding to a highlight portion, and the above-mentioned processing was carried out. After the processing, U-3500 Model Spectrophotometer, (trade name) manufactured by Hitachi Ltd., was used, to measure the absorbance of the respective processed samples at 510 nm. Separately, the fixing composition was stored at 35° C. for 5 days, and then the development processing and measurement were performed in the same manner as above. The results are shown in Table 1. In the column "Agent for decreasing color-remains" in Table 1, numbers I-6), II-6) and the like each represent exemplified compounds I-6), II-6) and the like represented by the above formula (I) or (II), respectively.

TABLE 1

| | | Immediately after the preparation | | After the storage at 35° C. for 5 days | | |
|---|---|---|---|---|---|---|
| Sample No. | Agent for decreasing color-remains | D (510 nm) | ΔD | D (510 nm) | ΔD | Remarks |
| 1 | Not added | 0.166 | — | 0.167 | — | Comparative Example |
| 2 | S-1 | 0.147 | 0.019 | 0.163 | 0.004 | Comparative Example |
| 3 | S-2 | 0.155 | 0.011 | 0.158 | 0.009 | Comparative Example |
| 4 | S-3 | 0.157 | 0.009 | 0.157 | 0.010 | Comparative Example |
| 5 | I-6) | 0.143 | 0.023 | 0.144 | 0.023 | This invention |
| 6 | I-8) | 0.158 | 0.008 | 0.159 | 0.008 | This invention |
| 7 | I-10) | 0.151 | 0.015 | 0.151 | 0.016 | This invention |

TABLE 1-continued

| Sample No. | Agent for decreasing color-remains | Immediately after the preparation D (510 nm) | Immediately after the preparation ΔD | After the storage at 35° C. for 5 days D (510 nm) | After the storage at 35° C. for 5 days ΔD | Remarks |
|---|---|---|---|---|---|---|
| 8 | I-14) | 0.145 | 0.021 | 0.143 | 0.024 | This invention |
| 9 | I-17) | 0.150 | 0.016 | 0.149 | 0.018 | This invention |
| 10 | I-41) | 0.147 | 0.019 | 0.148 | 0.019 | This invention |
| 11 | I-48) | 0.149 | 0.017 | 0.150 | 0.017 | This invention |
| 12 | II-6) | 0.148 | 0.018 | 0.147 | 0.020 | This invention |
| 13 | II-8) | 0.150 | 0.016 | 0.150 | 0.017 | This invention |
| 14 | II-18) | 0.146 | 0.020 | 0.145 | 0.022 | This invention |

Compounds for comparison

Compound

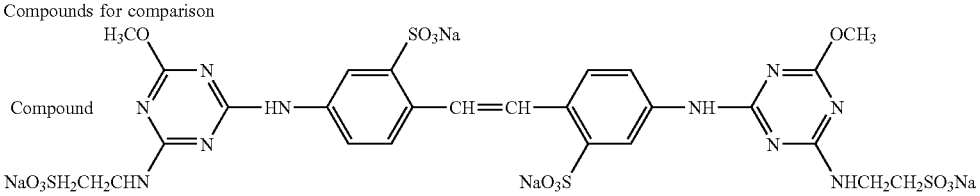

α

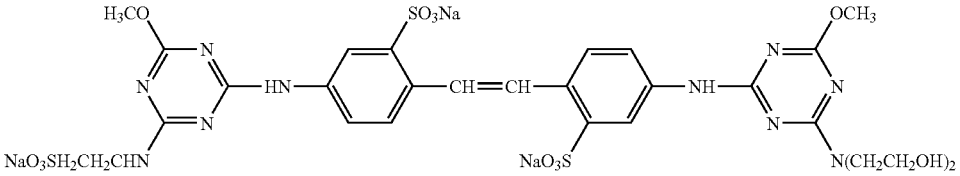

β

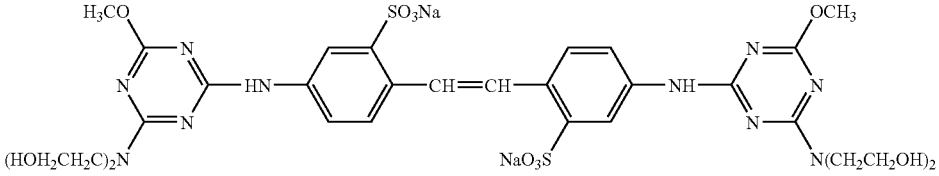

γ

S-1

A mixture in about 1:2:1 (molar ratio) of α, β, γ

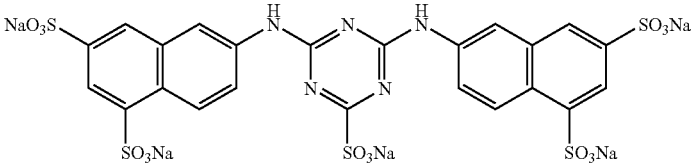

S-2

Compound described in U.S. Pat. No. 6,153,364

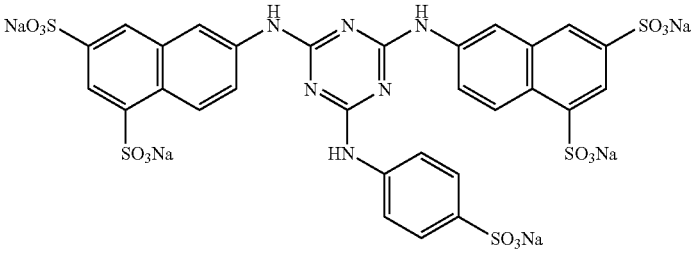

S-3

Compound described in U.S. Pat. No. 6,288,277B1

In Table 1, D (510 nm) represents absorbance at 510 nm, and ΔD represents the difference between absorbance when the agent for decreasing color-remains is added, and the absorbance when the agent is not added. When the D (510 nm) is smaller or ΔD is larger, the color-remains decreasing effect is larger.

It can be understood from the results shown in the Table 1 that the samples utilizing the photographic processing composition of the present invention, immediately after the fixing composition was prepared, exhibited the color-remains decreasing effect at a similar level as the sample utilizing Compound S-1 for comparison, and that the effect was kept even after the fixing compositions to be used were stored at 35° C. for 5 days. On the other hand, the sample utilizing Compound S-1 for comparison became to have almost no color-remains decreasing effect after the fixing composition for comparison was stored.

The samples utilizing the photographic processing composition of the present invention each had quite higher color-remains decreasing effects than the samples utilizing Compound S-2 or S-3 for comparison, at either time of immediately after the fixing composition to be used was prepared, or after the fixing composition was stored at 35° C. for 5 days.

From the above, it can be understood that the photographic composition of the present invention is excellent in color-remains decreasing effect, and exhibits the effect stably.

Example 2

(1) Preparation of a bleaching composition

| | |
|---|---|
| Disodium ethylenediamine-tetraacetate dihydrate | 4.0 g |
| Fe(III) ammonium ehtylene-diaminetetraacetate dihydrate | 240 g |
| Potassium bromide | 200 g |
| Ammonium nitrate | 20 g |
| Compound for use in the present invention represented by the formula (I) or (II) (see Table 2 below) | 1.2 mM |
| Water to make the total volume to | 1000 mL |
| pH (adjusted with nitric acid and NaOH at 25° C.) | 5.50 |

(2) Development processing

The development processing was carried out in the same manner as in Example 1, except that the bleaching composition prepared in the above (1) was diluted by half, to prepare a tank solution for a bleaching step, and that the fixing composition to be used was Fujichrome fixing agent/replenisher CR-56P H6/H6-R (each trade name, manufactured by Fuji Photo Film Co., Ltd.) of Process CR-56P manufactured by Fuji Photo Film Co., Ltd.

(3) Evaluation

A photosensitive material sample: Fujichrome PROVIA 100F (trade name) manufactured by Fuji Photo Film Co., Ltd., was subjected to light-exposure corresponding to a highlight portion, and the above-mentioned processing was carried out. After the processing, U-3500 Model Spectrophotometer manufactured by Hitachi Ltd. was used, to measure the absorbance of the processed samples at 540 nm. Separately, the bleaching composition was stored at 35° C. for 5 days, and then the development processing and measurement were performed in the same manner as above. The results are shown in Table 2.

TABLE 2

| Sample No. | Agent for decreasing color-remains | Immediately after the preparation D (540 nm) | Immediately after the preparation ΔD | After the storage at 35° C. for 5 days D (540 nm) | After the storage at 35° C. for 5 days ΔD | Remarks |
|---|---|---|---|---|---|---|
| 15 | Not added | 0.186 | — | 0.188 | — | Comparative Example |

TABLE 2-continued

| Sample No. | Agent for decreasing color-remains | Immediately after the preparation D (540 nm) | Immediately after the preparation ΔD | After the storage at 35° C. for 5 days D (540 nm) | After the storage at 35° C. for 5 days ΔD | Remarks |
|---|---|---|---|---|---|---|
| 16 | I-2) | 0.173 | 0.013 | 0.176 | 0.012 | This invention |
| 17 | I-3) | 0.175 | 0.011 | 0.176 | 0.012 | This invention |
| 18 | I-8) | 0.168 | 0.018 | 0.168 | 0.020 | This invention |
| 19 | I-12) | 0.169 | 0.017 | 0.169 | 0.016 | This invention |
| 20 | II-2) | 0.170 | 0.016 | 0.172 | 0.016 | This invention |
| 21 | II-12) | 0.176 | 0.010 | 0.177 | 0.011 | This invention |

In Table 2, D (540 nm) represents absorbance at 540 nm and ΔD represents the difference between absorbance when the agent for decreasing color-remains is added and the absorbance when the agent is not added. When the D (540 nm) is smaller or ΔD is larger, the color-remains decreasing effect is larger.

From the results shown in Table 2, it can be understood that, even when it is a bleaching composition, the photographic processing composition of the present invention similarly exhibited excellent color-remains decreasing effect immediately after the bleaching composition was prepared, and even after the bleaching composition was stored at 35° C. for 5 days.

Example 3

Processing chemicals of Process E-6, manufactured by Eastman Kodak, were used in the steps of the first development, the reversal, the color development, the pre-bleaching, the bleaching, and the final rinse in Example 1, and they were also used in the steps of the first developing, the reversal, the color development, the pre-bleaching, the fixing, and the final rinse in Example 2, respectively, to perform development processings and evaluations in the same manner. Separately, processing chemicals of Pro 6, manufactured by Fuji Hunt, were used in the steps of the first development, the reversal, the color development, the pre-bleaching, the bleaching, and the final rinse in Example 1, and they were also used in the steps of the first developing, the reversal, the color development, the pre-bleaching, the fixing, and the final rinse in Example 2, respectively, to perform development processings and evaluations in the same manner.

In all cases, the photographic processing composition of the present invention gave results that they were excellent in color-remains decreasing effect, and that the effect was stably exhibited, similarly in Example 1 or 2.

Example 4

(1) Preparation of a color-developing composition

| | |
|---|---|
| Water | 800 mL |
| Diethylenetriaminepentaacetate | 2.0 g |
| Sodium 4,5-dihydroxybenzene-1,3-disulfonate | 0.4 g |

-continued

| | |
|---|---|
| Disodium-N,N-bis(sulfonatoethyl) hydroxylamine | 4.0 g |
| Sodium sulfite | 4.0 g |
| Potassium bromide | 1.4 g |
| Diethylene glycol | 10.0 g |
| Ethylene urea | 3.8 g |
| Compound for use in the present invention represented by the formula (I) or (II) (see Table 3) | 2.0 mmol |
| Hydroxylamine sulfate | 2.0 g |
| 2-Methyl-4-[N-ethyl-N-(β-hydroxyethyl)amino]aniline sulfate | 4.7 g |
| Potassium carbonate | 39.0 g |
| Water to make the total volume to | 1000 mL |
| pH (adjusted with sulfuric acid and KOH at 25° C.) | 10.05 |

(2) Development processing

Respective processing chemicals of Process CN-16L manufactured by Fuji Photo Film Co., Ltd. were used in the steps of bleaching, fixing and stabilization. According to the methods for adjusting the chemicals, respective tank solutions were prepared. Film Processor FP560B (trade name) manufactured by Fuji Photo Film Co., Ltd. was used, to perform development processing according to the processing specification of Process CN-16L.

| Processing step | Processing composition | Temperature | Time |
|---|---|---|---|
| Color development | Composition prepared in the above (1) (see Table 3) | 37.8° C. | 3 min and 5 sec |
| Bleaching | Fuji Color Just It bleaching replenisher CN-16L N2-R (trade name, manufactured by Fuji Photo Film Co., Ltd.) | 38.0° C. | 50 sec |
| Fixing (1) | Fuji Color Just It fixing replenisher CN-16L N3-R (trade name, manufactured by Fuji Photo Film Co., Ltd.) | 38.0° C. | 50 sec |
| Fixing (2) | Fuji Color Just It fixing replenisher CN-16L N3-R (trade name, manufactured by Fuji Photo Film Co., Ltd.) | 38.0° C. | 50 sec |
| Super rinse | Water | 38.0° C. | 30 sec |
| Stabilization (1) | Fuji Color Just It stabilization replenisher CN-16L N4-R and Fuji Super Conditioner FSC (each trade name, manufactured by Fuji Photo Film Co., Ltd.) | 38.0° C. | 20 sec |
| Stabilization (2) | Fuji Color Just It stabilization replenisher CN-16L N4-R and Fuji Super Conditioner FSC (each trade name, manufactured by Fuji Photo Film Co., Ltd.) | 38.0° C. | 20 sec |
| Drying | | 60° C. | 1 min and 30 sec |

(3) Evaluation

A photosensitive material sample, non-exposed Fuji Color Superior Zoom Master 800 100F (trade name) manufactured by Fuji Photo Film Co., Ltd. was subjected to the above-mentioned processing. After the processing, the absorbance at 540 nm was measured using U-3500 Model Spectrophotometer manufactured by Hitachi Ltd. The results are shown in Table 3.

TABLE 3

| Sample No. | Agent for decreasing color-remains | D (540 nm) | ΔD | Remarks |
|---|---|---|---|---|
| 22 | Not added | 0.650 | — | Comparative Example |
| 23 | I-6) | 0.592 | 0.058 | This invention |
| 24 | I-8) | 0.621 | 0.029 | This invention |
| 25 | I-10) | 0.618 | 0.032 | This invention |
| 26 | I-14) | 0.602 | 0.048 | This invention |
| 27 | II-2) | 0.598 | 0.052 | This invention |
| 28 | II-8) | 0.610 | 0.040 | This invention |

In Table 3, D (540 nm) represents absorbance at 540 nm, and ΔD represents the difference between absorbance when the agent for decreasing color-remains is added and the absorbance when the agent is not added. When the D (540 nm) is smaller or ΔD is larger, the color-remains decreasing effect is larger.

From the results shown in Table 3, it can be understood that when the photographic processing composition of the present invention was the color-developing composition, the composition exhibited effective color-remain decreasing effect.

Example 5

(1) Preparation of a stabilizing composition

| | |
|---|---|
| Water | 800 mL |
| Compound for use in the present invention represented by the formula (I) or (II) (see Table 4) | 0.4 mmol |
| Sodium p-toluenesulfinate | 0.03 g |
| Polyoxyethylene mono-n-decyl ether (oxyethylene average polymerization degree: 15) | 0.20 g |
| Disodium etylenediaminetetraacetate | 0.05 g |
| 1,2,4-Triazole | 1.3 g |
| 1,2-Benzoisothiazoline-3-one | 0.10 g |
| Water to make the total volume to | 1000 mL |
| pH (adjusted with aqueous ammonia and nitric acid at 25° C.) | 7.00 |

(2) Development processing

The stabilizing composition prepared in the above (1) was used in the stabilizing step. The color-developing composition to be used was composed of Fuji Color Just It Color-Development Replenisher CN-16L N1-R and Fuji Color Just It Color-Development Starter CN-16L N1-S (each trade name, manufactured by Fuji Photo Film Co., Ltd.). In the same manner as in Example 4, except for the above, Film Processor FP560B (trade name), manufactured by Fuji Photo Film Co., Ltd., was used, to perform development processing, according to the processing specification of Process CN-16L.

(3) Evaluation

A photosensitive material sample, non-exposed Fuji Color Superior Zoom Master 800 100F (trade name) manufactured by Fuji Photo Film Co., Ltd. was subjected to the above-mentioned processing. After the processing, the absorbance at 540 nm was measured using U-3500 Model Spectrophotometer manufactured by Hitachi Ltd. The results are shown in Table 4.

TABLE 4

| Sample No. | Agent for decreasing color-remains | D (540 nm) | ΔD | Remarks |
|---|---|---|---|---|
| 29 | Not added | 0.648 | — | Comparative Example |
| 30 | I-6) | 0.619 | 0.029 | This invention |
| 31 | I-8) | 0.630 | 0.018 | This invention |
| 32 | I-10) | 0.628 | 0.020 | This invention |
| 33 | I-14) | 0.620 | 0.028 | This invention |
| 34 | II-2) | 0.626 | 0.022 | This invention |
| 35 | II-8) | 0.632 | 0.015 | This invention |

In Table 4, D (540 nm) represents absorbance at 540 nm, and ΔD represents the difference between absorbance when the agent for decreasing color-remains is added and the absorbance when the agent is not added. When the D (540 nm) is smaller or ΔD is larger, the color-remain decreasing effect is larger.

From the results shown in Table 4, it can be understood that when the photographic processing composition of the present invention was the stabilizing composition, the composition exhibited effective color-remain decreasing effect.

Example 6

Respective processing chemicals of Process C-41 (Kodak FLEXICOLOR Bleaching Agent III, Fixing Agent and Final Rinse Solution (each trade name)), manufactured by Eastman Kodak, were ,used in bleaching, fixing, and stabilization in Example 4, to perform development processing and evaluation according to the processing specification of Process C-41. Separately, respective processing chemicals of Process C-41 (Kodak FLEXICOLOR Developing Agent, Bleaching Agent III and Fixing Agent (each trade name)), manufactured by Eastman Kodak were used in color-development, bleaching, and fixing in Example 5, to perform development processing and evaluation according to the processing specification of Process C-41.

In either case, the photographic processing composition of the present invention gave the results that the composition of the invention was excellent in color-remains decreasing effect, similarly in Example 4 or 5.

Example 7

(1) Preparation of a color-developing composition

| | |
|---|---|
| Water | 800 mL |
| Triisopropanolamine | 8.5 g |
| Ethylenediainine-tetraacetic acid | 4.0 g |
| Sodium 4,5-dihydroxybenzene-1,3-disulfonate | 0.5 g |
| Disodium-N,N-bis(sulfonatoethyl) hydroxylamine | 6.5 g |
| Sodium sulfite | 0.2 g |
| Potassium chloride | 10.0 g |
| Potassium bromide | 0.03 g |
| Fluorescent whitening agent Blankophor UWS (trade name, manufactured by Bayer AG) | 0.4 g |
| Compound for use in the present invention represented by the formula (I) or (II) (see Table 5) | 1.5 mmol |
| 2-Methyl-4-[N-ethyl-N-(β-methanesulfonamido-ethyl)]aniline 3/2 sulfate monohydrate | 4.9 g |
| Potassium carbonate | 26.3 g |
| Water to make the total volume to | 1000 mL |
| pH (adjusted with sulfuric acid and KOH at 25° C.) | 10.15 |

(2) Development processing

Respective processing chemicals of Process CP-47L manufactured by Fuji Photo Film Co., Ltd. were used in bleach-fixing. According to the methods for adjusting the chemicals, the tank solution was prepared. Printer Processor PP728C (trade name) manufactured by Fuji Photo Film Co., Ltd. was used, to perform development processing according to the processing specification of Process CP-47L.

| Processing step | Processing composition | Temperature | Time |
|---|---|---|---|
| Color development | Composition prepared in the above (1) (see Table 5) | 38.5° C. | 45 sec |
| Bleach-fixing | Fuji Color Just It bleaching replenisher CP-47L P2-R (trade name, manufactured by Fuji Photo Film Co., Ltd.) | 38.0° C. | 45 sec |
| Rinse | Fuji Super Conditioner FSC (trade name, manufactured by Fuji Photo Film Co., Ltd.) | 38.0° C. | 90 sec |
| Drying | | 70° C. | |

(3) Evaluation

A photosensitive material sample: non-exposed Fuji Color Paper Super FA9 (trade name) manufactured by Fuji Photo Film Co., Ltd. was subjected to the above-mentioned processing. After the processing, U-3500 Model Spectrophotometer, manufactured by Hitachi Ltd., to which a 150-mm diameter integrating sphere was fitted, was used, to measure the absorbance of the sample at 515 nm. The results are shown in Table 5.

TABLE 5

| Sample No. | Agent for decreasing color-remains | D (515 nm) | ΔD | Remarks |
|---|---|---|---|---|
| 36 | Not added | 0.085 | — | Comparative Example |
| 37 | I-8) | 0.080 | 0.005 | This invention |
| 38 | I-10) | 0.077 | 0.008 | This invention |
| 39 | I-39) | 0.075 | 0.010 | This invention |
| 40 | I-40) | 0.079 | 0.006 | This invention |
| 41 | II-12) | 0.079 | 0.006 | This invention |
| 42 | II-18) | 0.075 | 0.010 | This invention |

In Table 5, D (515 nm) represents absorbance at 515 nm, and ΔD represents the difference between absorbance when the agent for decreasing color-remains is added and absorbance when the agent is not added. When the D (515 nm) is smaller or ΔD is larger, the color-remain decreasing effect is larger.

From the results shown in Table 5, it can be understood that the photographic processing composition of the present invention exhibited effective color-remain decreasing effect.

Example 8

Stability against precipitation (1) Separation of additive compositions

The compound represented by formula (I) or the compound for comparison (0.1 mol/L) was mixed with the water-soluble aliphatic compound shown in Table 6 (an amount to be added shown in Table 6), to prepare an additive composition. Additive compositions to which no water-soluble aliphatic compound was added were prepared as comparative examples.

(2) Evaluation

The thus-prepared additive compositions were each put into respective glass bottles for storage at −5° C., and at room temperature for 4 weeks. The evaluation of the test results was performed by judging the liquid state of each of the compositions with the lapse of time with the naked eye. The compositions were ranked as the following five levels: "xx" for a level in which a conspicuous amount of precipitation was generated; "x" for a level in which precipitation was evidently generated; "Δ" for a level in which a slight amount of precipitation was generated; "○" for a level in which no precipitation was generated but turbid, and "◎" for a completely transparent level in which neither turbidity nor precipitation was found. The results are shown in Table 6.

TABLE 6

| Sample No. | Compound of formula (I), or Compound for comparison | Water-soluble aliphatic compound: Compound | Water-soluble aliphatic compound: Added amount (mol/L) | Precipitation evaluation (−5° C.) | Precipitation evaluation (room temperature) | Remarks |
|---|---|---|---|---|---|---|
| 43 | S-1 | DEG | 6.5 | xx | x | Comparative example |
| 44 | S-2 | DEG | 6.5 | x | Δ | Comparative example |
| 45 | S-3 | DEG | 6.5 | x | Δ | Comparative example |
| 46 | I-8) | — | — | x | Δ | Comparative example |
| 47 | I-8) | TIPA | 3.5 | ◎ | ◎ | This invention |
| 48 | I-8) | DEG | 6.5 | ◎ | ◎ | This invention |
| 49 | I-39) | DEG | 6.5 | ○ | ◎ | This invention |
| 50 | I-41) | — | — | xx | Δ | Comparative example |
| 51 | I-41) | TIPA | 3.5 | ○ | ◎ | This invention |
| 52 | I-41) | DEG | 6.5 | ◎ | ◎ | This invention |
| 53 | I-42) | DEG | 6.5 | ○ | ◎ | This invention |
| 54 | I-43) | DEG | 6.5 | ○ | ◎ | This invention |

In the table, DEG and TIPA represent diethylene glycol and triisopropanolamine, respectively.

It can be understood from the results shown in Table 6 that the compound represented by formula (I) was stabilized with the water-soluble aliphatic compound. It was demonstrated that the additive composition of the present invention can be stably stored at −5° C. and at 0° C. without generating any precipitation.

Example 9

Color-remains Decreasing Effect (1) Photosensitive material samples

The following commercially available color reversal films were used as photosensitive material samples A to C.

Sample A: Fujichrome PROVIA (trade name, manufactured by Fuji Photo Film Co., Ltd.)

Sample B: Fujichrome VELVIA (trade name, manufactured by Fuji Photo Film Co., Ltd.)

Sample C: EKTACHROME E-100S (trade name, manufactured by Eastman Kodak)

(2) Development processing

Photosensitive material samples, which had been gray-exposed to have an average density, were subjected to a continuous processing (running test) according to the following processing steps, until the amount of the first black-and-white developing solution became half (0.5 round). Samples A, B and C were used at a ratio of 2:1:1.

The development processing was performed in such a manner that the samples each were carried while being hung from a hanger.

| Processing step | Temperature | Time | Tank solution | Replenisher volume* |
|---|---|---|---|---|
| 1st black-and-white development | 38.0° C. | 6 min. | 12 L | 2,200 mL |
| 1st washing | 38.0° C. | 2 min. | 4 L | 7,500 mL |
| Reversal | 38.0° C. | 2 min. | 4 L | 1,100 mL |
| Color-development | 38.0° C. | 6 min. | 12 L | 2,200 mL |
| Pre-bleaching | 38.0° C. | 2 min. | 4 L | 1,100 mL |
| Bleaching | 38.0° C. | 6 min. | 2 L | 220 mL |
| Fixing | 38.0° C. | 4 min. | 8 L | 1,100 mL |
| 2nd washing | 38.0° C. | 6 min. | 8 L | 7,500 mL |
| Final rinsing | 25.0° C. | 1 min. | 2 L | 1,100 mL |

(Note)

*Replenisher volume per $m^2$ of the photosensitive material to be processed

Compositions of each processing solution were as follows.

| | (Tank solution) | (Replenisher) |
|---|---|---|
| (1st black-and-white development solution) | | |
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Potassium hydroquinone-monosulfonate | 15 g | 20 g |
| Potassium bicarbonate | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene qlycol | 13 g | 15 g |
| Water to make the total volume to | 1000 mL | 1000 mL |
| pH (adjusted with sulfuric acid and KOH at 25° C.) | 9.60 | 9.60 |
| (Reversal solution) | | |
| Pentasodium nitrilo-N,N,N-trimethylenephosphonate | 3.0 g | Each amount was the same as the tank solution |
| Stannous chloride dihydrate | 1.0 g | |
| p-Aminophenol | 0.1 g | |
| Sodium hydroxide | 8 g | |
| Propionic acid | 15 mL | |
| Water to make the total volume to | 1000 ml | |
| pH (adjusted with acetic acid and KOH at 25° C.) | 6.00 | |
| (Color-development solution) | | |
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Sodium bromide | 0.7 g | — |
| Potassium iodide | 40 mg | — |
| Sodium hydroxide | 3.0 g | 3.0 g |
| Citrazinic acid | 0.5 g | 0.5 g |
| N-Ethyl-N-(β-methanesulfonamido-ethyl)-3-methyl-4-aminoaniline 3/2 sulfate monohydrate | 11 g | 11 g |
| 3,6-Dithiaoctane-1,8-diol | 1.0 g | 1.0 g |
| Water to make the total volume to | 1000 ml | 1000 ml |
| pH (adjusted with sulfuric acid and KOH at 25° C.) | 11.80 | 12.00 |
| (Pre-bleaching Solution) | | |
| Disodium ethylenediamine-tetraacetate dihydrate | 8.0 g | 8.0 g |
| Sodium sulfite | 6.0 g | 8.0 g |
| 1-Thioglycerol | 0.4 g | 0.4 g |
| Formaldehyde/sodium bisulfite adduct | 20 g | 25 g |
| Methanol | 2 g | 2 g |
| Water to make the total volume to | 1000 ml | 1000 ml |
| pH (adjusted with acetic acid and NaOH at 25° C.) | 6.30 | 6.10 |
| (Bleaching solution) | | |
| Disodium ethylenediamine-tetraacetate dihydrate | 2.0 g | 4.0 g |
| Fe(III) ammonium ethylene-diaminetetraacetate dihydrate | 120 g | 240 g |
| Potassium bromide | 100 g | 200 g |
| Ammonium nitrate | 10 g | 20 g |
| Water to make the total volume to | 1000 ml | 1000 ml |
| pH (adjusted with nitric acid and NaOH at 25° C.) | 5.70 | 5.50 |

-continued

| | (Tank solution) | (Replenisher) |
|---|---|---|
| (Fixing solution) | | |
| Additive composition (Sample No. 52), or None (not added) | 1 mL | Each amount was the same as the tank solution |
| Ammonium thiosulfate | 80 g | |
| Sodium sulfite | 5.0 g | |
| Sodium bisulfite | 5.0 g | |
| Water to make the total volume to | 1000 ml | |
| pH (adjusted with acetic acid and aqueous ammonia at 25° C.) | 6.60 | |
| (Stabilizing solution) | | |
| 2-benzoisothiazoion-3-one | 0.02 g | Each amount was the same as the tank solution |
| Dipropylene glycol | 0.3 g | |
| Organic silicon surfactant | 0.2 g | |
| Water to make the total volume to | 1000 ml | |
| pH (25° C.) | 7.0 | |

(3) Evaluation

The photosensitive material Samples A to C were subjected to exposure corresponding to highlight portions, and then to development processing. U-3500 Model Spectrophotometer manufactured by Hitachi Ltd. was used to measure the processed photosensitive material samples. In this way, the following were obtained: the absorbance of Sample A at 540 nm, that of Sample B at 510 nm, and that of Sample C at 575 nm. Then, a Sample No. 52, which was the additive composition of the present invention as prepared in Example 8, was added to each of the fixing solution and the fixing replenisher, in an amount of 1.5 mL per liter. Thereafter, the same development and measurement as described above were performed. Further, the Sample No. 52 was added to each of the fixing solution and the fixing replenisher, in an amount of 1.5 mL per liter. Thereafter, the same development and measurement as described above were performed. At this time, the total added amount of the additive composition was 3 mL.

TABLE 7

| Sample No. 52 | Sample A Absorbance at 540 nm | Sample B Absorbance at 510 nm | Sample C Absorbance at 575 nm |
|---|---|---|---|
| Before the addition (not added) | 0.178 | 0.167 | 0.217 |
| After the addition of 1.5 mL | 0.164 | 0.153 | 0.192 |
| After the addition of 3.0 mL | 0.160 | 0.148 | 0.186 |

Then results shown in Table 7 demonstrate that absorbance of all samples decreased with increased addition of the additive compositions of the present invention. Thus, it can be understood that stain was decreased in highlight portions in accordance with the added amount of the additive compositions. In other words, by changing the added amount in accordance with the stain level at the time of the continuous processing, the color tone of high-light portions can be adjusted. Moreover, the color tone can be precisely adjusted, since the additive composition of the present invention has quite high storage stability.

Having described our invention as related to the present embodiments, it is our intention that the invention not be limited by any of the details of the description, unless otherwise specified, but rather be construed broadly within its spirit and scope as set out in the accompanying claims.

We claim:

1. A photographic processing composition, comprising at least one compound selected from the group consisting of a compound represented by formula (I) and a compound represented by formula (II):

$$A_1\text{-}X\text{-}L\text{-}Y\text{-}A_2 \quad (I)$$

wherein, in formula (I), $A_1$ and $A_2$ each independently represent an aryl group or an aromatic heterocyclic group, in which $A_1$ and $A_2$ do not include a triazinyl group; L represents an arylene group or a divalent aromatic heterocyclic group, in which L does not include a triazinylene group; X and Y each independently represent a divalent linking group; the compound represented by formula (I) contains at least two of a group represented by —$SO_3M$ or —$CO_2M$; M represents a hydrogen atom, an alkali metal, an alkali earth metal, an ammonium or a pyridinium; a molecule represented by the formula (I) does not contain a group represented by —N═N— or —SH; and when L is a divalent aromatic heterocyclic group, X and Y each do not represent a divalent linking group singly composed of $N(R_1)$, S or O, in which $R_1$ represents a hydrogen atom, or an alkyl group having 1 to 6 carbon atoms;

$$\left[A_{11}\text{—}(X_1\text{—}A_{12})_n\right]\begin{cases}(SO_3M_1)_r\\(CO_2M_1)_s\end{cases} \quad (II)$$

wherein, in formula (II), $A_{11}$ represents a tri- or tetra-valent aromatic hydrocarbon group or a tri- or tetra-valent aromatic heterocyclic group, in which $A_{11}$ is not a trivalent group of triazine; $A_{12}$ represents an aryl group or an aromatic heterocyclic group; $X_1$ represents a divalent linking group; $M_1$ represents a hydrogen atom, an alkali metal, an alkali earth metal, an ammonium or a pyridinium; a molecule represented by the formula (II) does not contain a group represented by —N═N— or —SH; n is an integer of 3 or 4; and r and s each are an integer of 0 to 10, in which r+s is 2 or more.

2. The photographic processing composition according to claim 1, wherein, in formula (I), X and Y each independently represent a —$CON(R_1)$— group, a —$SO_2N(R_1)$— group or a —$CO_2$— group; and $R_1$ is a hydrogen atom or an alkyl group having 1 to 6 carbon atoms.

3. The photographic processing composition according to claim 1, wherein, in formula (I), L represents a phenylene group, a naphthylene group or an anthrylene group, each of which may have a substituent.

4. The photographic processing composition according to claim 1, wherein, in formula (II), $A_{11}$ represents a tri- or tetra-valent group of benzene, naphthalene or anthracene, each of which may have a substituent.

5. The photographic processing composition according to claim 1, wherein, in formula (I), $A_1$ and $A_2$ each independently represent a 5,7-disulfo-2-naphthyl group or a 3,6-disulfo-2-naphthyl group.

6. The photographic processing composition according to claim 1, which is used in color-development.

7. The photographic processing composition according to claim 1, which is used in bleaching or bleach-fixing.

8. The photographic processing composition according to claim 1, which is used in fixing.

9. The photographic processing composition according to claim 1, which is used in water washing or stabilizing.

10. The photographic processing composition according to claim 1, which is an additive composition for photographic processing, and which at least comprises:

a) 0.01 to 20 mmol/L of at least one compound represented by formula (I):

$$A_1\text{-}X\text{-}L\text{-}Y\text{-}A_2 \quad (I)$$

wherein, in formula (I), $A_1$ and $A_2$ each independently represent an aryl group or an aromatic heterocyclic group, in which $A_1$ and $A_2$ do not include a triazinyl group; L represents an arylene group or a divalent aromatic heterocyclic group, in which L does not include a triazinylene group; X and Y each independently represent a divalent linking group; the compound represented by formula (I) contains at any position of the groups in a molecule thereof, at least two of a group represented by —$SO_3M$ or —$CO_2M$; M represents a hydrogen atom, an alkali metal, an alkali earth metal, an ammonium or a pyridinium; the molecule represented by formula (I) does not contain a group represented by —N═N— or —SH; and when L is a divalent aromatic heterocyclic group, X and Y each do not represent a divalent linking group singly composed of $N(R_1)$, S or O, in which $R_1$ represents a hydrogen atom, or an alkyl group having 1 to 6 carbon atoms; and b) at least one water-soluble aliphatic compound having 2 to 10 carbon atoms and a molecular mass of less than 200, having in a molecule thereof at least two groups selected from the group consisting of an amino group and a hydroxyl group, and having a molarity of 0.5 mole or more per mole of the compound represented by formula (I).

11. The additive composition according to claim 10, which is added to a fixing solution or a fixing replenisher.

12. The additive composition according to claim 10, which is added to a bleaching solution or a bleaching replenisher.

13. The additive composition according to claim 10, which is added to a pre-bleaching solution or a pre-bleaching replenisher.

14. The additive composition according to claim 10, which is added to a developing solution or a developing replenisher.

15. The additive composition according to claim 10, which is added to a stabilizing solution or a stabilizing replenisher.

* * * * *